US008816178B2

(12) United States Patent
Gelb

(10) Patent No.: US 8,816,178 B2
(45) Date of Patent: Aug. 26, 2014

(54) SYSTEM OF REMOVING OVERTONES AND RINGS IN A DRUM SET

(71) Applicant: Philip S. Gelb, Scottsdale, AZ (US)

(72) Inventor: Philip S. Gelb, Scottsdale, AZ (US)

( * ) Notice: Subject to any disclaimer, the term of this patent is extended or adjusted under 35 U.S.C. 154(b) by 0 days.

(21) Appl. No.: 13/887,161

(22) Filed: May 3, 2013

(65) Prior Publication Data

US 2013/0305898 A1 Nov. 21, 2013

Related U.S. Application Data

(60) Provisional application No. 61/647,871, filed on May 16, 2012.

(51) Int. Cl.
*G10D 13/02* (2006.01)

(52) U.S. Cl.
CPC ..... *G10D 13/021* (2013.01)
USPC ..... 84/411 R

(58) Field of Classification Search
CPC ..... G10D 13/021
USPC ..... 84/411 R
See application file for complete search history.

(56) References Cited

U.S. PATENT DOCUMENTS 818,289 A * 4/1906 Randall ..... 84/294
2,531,634 A * 11/1950 Lawrence ..... 181/164
3,289,520 A * 12/1966 Simpson ..... 84/411 R
4,284,166 A * 8/1981 Gale ..... 181/156
4,731,141 A * 3/1988 Thirion ..... 156/171
4,742,753 A * 5/1988 Speed ..... 84/414
4,790,228 A * 12/1988 Thirion ..... 84/411 R
4,805,514 A * 2/1989 Billings ..... 84/411 M
5,095,796 A * 3/1992 Genna ..... 84/414
D359,958 S * 7/1995 Frodelius ..... D14/208
5,623,132 A * 4/1997 Gahm ..... 181/156
6,198,033 B1 * 3/2001 Lovelett ..... 84/411 R
6,275,597 B1 * 8/2001 Roozen et al. ..... 381/345
6,677,512 B1 * 1/2004 Chen ..... 84/411 R
6,700,044 B1 * 3/2004 Bencomo, Jr. ..... 84/411 R
6,927,330 B2 * 8/2005 May ..... 84/411 R
6,957,714 B2 * 10/2005 Takahashi et al. ..... 181/171
7,291,776 B2 * 11/2007 Dunnett ..... 84/411 R
7,485,791 B2 * 2/2009 Takegawa ..... 84/411 R
7,549,384 B2 * 6/2009 Nagler et al. ..... 114/182
7,582,820 B2 * 9/2009 Millender et al. ..... 84/411 R
D608,348 S * 1/2010 Gahm ..... D14/216
7,659,469 B2 * 2/2010 Belli ..... 84/411 R
7,674,963 B1 * 3/2010 Poggi ..... 84/312 R
7,692,082 B2 * 4/2010 Abe ..... 84/411 R
7,928,303 B2 * 4/2011 Millender et al. ..... 84/411 R
7,968,780 B2 * 6/2011 Millender et al. ..... 84/411 R
8,035,018 B2 * 10/2011 Bausch, III ..... 84/411 R (Continued)

*Primary Examiner* — Robert W Horn

(57) ABSTRACT

A system of removing undesirable overtones and rings in an acoustic drum includes a drum, a tuning port, and an attachment mechanism. The tuning port is attached to the drum by the attachment mechanism, and three different attachment mechanisms are used within the system to attach the tuning port. A plurality of dimples is positioned on the inner surface of the tuning port, and the tuning port includes a first, second, and third alternative embodiments. The first alternative embodiment, which has a flared end and a cylindrical end, can be attached with a drum shell of the drum by the first and second attachment mechanisms. The second alternative embodiment, which has two flared ends, can be attached with the drum shell by the first and second attachment mechanisms. The third alternative embodiment, which has two flared ends, can be attached with the drum shell by the third attachment mechanism.

19 Claims, 26 Drawing Sheets

(56) References Cited

U.S. PATENT DOCUMENTS

| | | | | |
|---|---|---|---|---|
| 8,294,013 | B2 * | 10/2012 | Lento | 84/411 R |
| 8,536,434 | B2 * | 9/2013 | Ruffino | 84/414 |
| 8,735,704 | B2 * | 5/2014 | Buchner | 84/411 R |
| 2005/0120863 | A1 * | 6/2005 | Dunnett | 84/411 R |
| 2008/0053291 | A1 * | 3/2008 | Dunnett | 84/411 R |
| 2008/0078279 | A1 * | 4/2008 | Belli | 84/411 R |
| 2008/0210078 | A1 * | 9/2008 | Millender et al. | 84/411 M |
| 2009/0019985 | A1 * | 1/2009 | Casanta | 84/411 R |
| 2010/0031802 | A1 * | 2/2010 | Millender et al. | 84/411 R |
| 2010/0037750 | A1 * | 2/2010 | Millender et al. | 84/411 R |
| 2013/0239776 | A1 * | 9/2013 | Schmidt | 84/411 R |
| 2013/0305898 | A1 * | 11/2013 | Gelb | 84/411 R |

* cited by examiner

SECTION A-A
SCALE 1 : 3

SECTION A-A
SCALE 1 : 3

SECTION A-A
SCALE 1 : 3

SECTION A-A
SCALE 1 : 3

SYSTEM OF REMOVING OVERTONES AND RINGS IN A DRUM SET

The current application claims a priority to the U.S. Provisional Patent application Ser. No. 61/647,871 filed on May 16, 2012.

FIELD OF THE INVENTION

The present invention relates generally to an apparatus for an acoustic drum. More specifically, the present invention is a system that redirects sound waves inside the acoustic drum to produce a deeper, richer, and fatter sound from the acoustic drum while eliminating unwanted rings and overtones in the drum.

BACKGROUND OF THE INVENTION

When a musician is playing an acoustic drum set, there is a desire to produce a deeper and richer sound with the acoustic drum set. Many devices and methods are used in the music industry to dampen drum heads so that the produced undesirable and unwanted overtones from toms, snare, base drums, etc can be removed or controlled. For example, musicians use drum rings around a batter head of the drum, place a pillow or blanket within the drum, place adhesive tapes on the batter head of the drum, and place gel packs on the batter head so that the acoustic drum can be damped. Most of these methods provide an unattractive appearance for the acoustic drum set and unable to perform up to the musician's standard. These methods are mere band-aid and do not address the root of the problem which actually takes away from the natural sound qualities and properties of the drum.

It is therefore an object of the present invention to provide a system of a drum, a tuning port, and an attachment mechanism that can be used on a snare drum, a tom-tom drum, bass drum, timbales, etc to produce a deeper, richer, and fatter sound. The present invention is able to remove the undesirable rings, sounds, and overtones of the acoustic drum while providing the desired sound effects for the musicians.

DETAIL DESCRIPTIONS OF THE INVENTION

Figure 1:
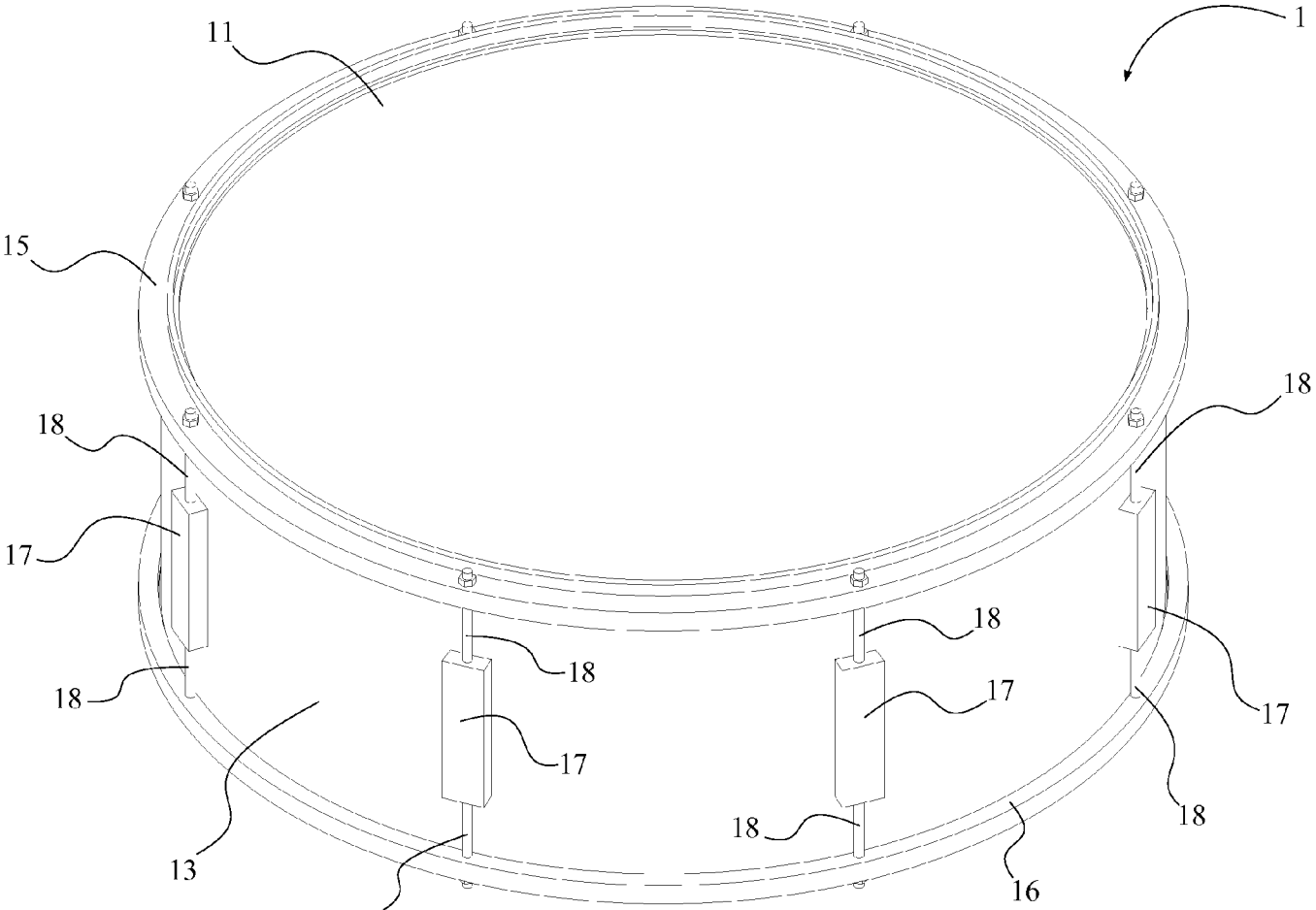
FIG. 1 is a top perspective view of a drum of the present invention.
Figure 2:
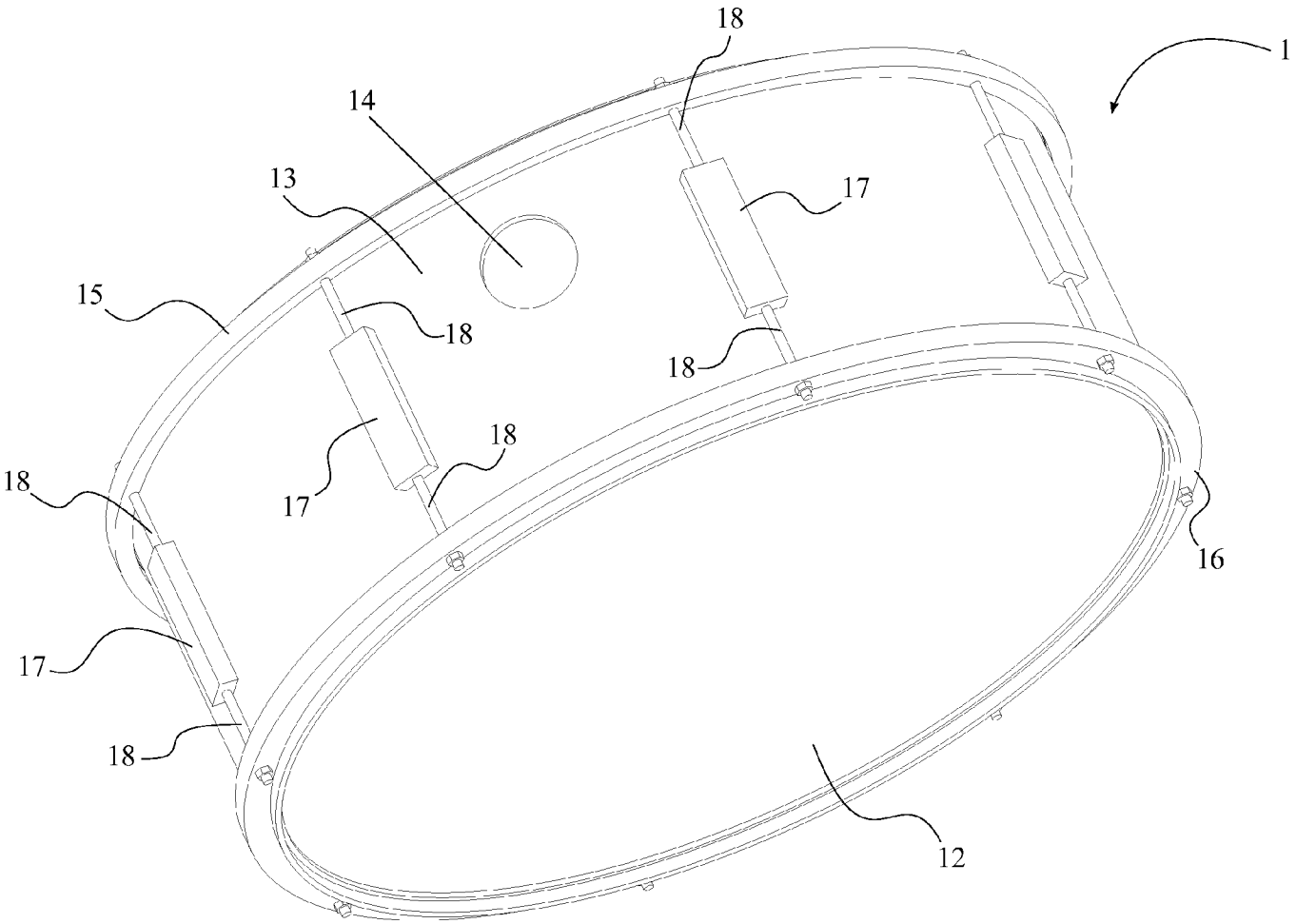
FIG. 2 is a bottom perspective view of the drum of the present invention.

All illustrations of the drawings are for the purpose of describing selected versions of the present invention and are not intended to limit the scope of the present invention.

The present invention is a system for removing overtone and resonance rings in an acoustic drum. The present invention comprises a tuning port 2, a drum 1, and an attachment mechanism 3, where the tuning port 2 is attached to the drum 1 from the attachment mechanism 3. The tuning port 2 is used only within acoustic drums and not with the electronic drums. When the tuning port 2 is attached to the drum 1, the tuning port 2 is able to remove undesirable rings, sounds, and overtones of the drum 1 as the drum 1 is played by an individual.

In reference to FIG. 1-FIG. 4, the drum 1, which can be a base drum, a floor tom drum, a snare drum, timbales, and a hanging tom drum, comprises a batter membrane 11, a resonant membrane 12, a drum shell 13, a first hoop 15, a second hoop 16, a mount, and a plurality of lugs 17. The batter membrane 11, which provides a surface area so that the individual can play the drum 1, is the top layer of the drum 1 and stretched across the drum shell 13 and connected to the first hoop 15. The resonant membrane 12, which defines the attack and the tone of the drum 1, is the bottom layer of the drum 1 and stretched across the drum shell 13 opposite from the batter membrane 11. The drum shell 13 provides a body so that the rest of the component of the drum 1 can be secured to the drum shell 13. The drum shell 13 is preferably made into a circular shape, but can also be made into any other geometric shapes. The drum shell 13 can be made of high strength materials such as wood, aluminum, brass, bronze, steel, carbon fiber, and acrylic. The plurality of lugs 17 comprises a plurality of tension rods 18, where the plurality of tension rods 18 is connected to the plurality of lugs 17. The plurality of lugs 17 and the plurality of tension rods 18 are equally spaced around the drum shell 13, and the plurality of lugs 17 is adjacently connected with the drum shell 13. The first hoop 15 and the second hoop 16 are adjustably attached to the drum shell 13 by the plurality of tension rods 18. The user of the drum 1 can adjust the tension of the batter membrane 11 and the resonant membrane 12 through the plurality of tension rods 18 since the plurality of tension rods 18 is attached with the first hoop 15 and the second hoop 16. The mount is connected on the drum shell 13, where the mount provides an attachment point in between the drum 1 and a supporting bracket, stand or rack.

In reference to FIG. 5-FIG. 13D, the tuning port 2 that comprises an outer surface 21, an inner surface 22, a plurality of dimples 23, an intake end portion 24, a central portion 25, and an output end portion 26 provides a hollow body so that the sound waves can pass through the tuning port 2 eliminating the undesirable rings, sounds, and overtones. In some instant, the tuning port 2 may also increase the volume of the drum 1. The outer surface 21 is oppositely positioned from the inner surface 22 along the tuning port 2. The plurality of dimples 23 is positioned on the inner surface 22, where the plurality of dimples 23 turbulates the boundary layer within the tuning port 2 while increasing adhesion and reducing eddies of the sound waves. The intake end portion 24, the central portion 25, and the output end portion 26 of the tuning port 2 are linearly positioned with each other, where the central portion 25 is linearly positioned in between the output end portion 26 and the intake end portion 24. The intake end portion 24 draws the sound waves from the drum 1, and the central portion 25 redirects the sound waves towards the output end portion 26 as the sound waves exits from the output end portion 26. Since the tuning port 2 redirects the sound waves from the inside of the drum 1 to the outside of the drum 1, less sound waves result into less reverberation and vibration of the batter membrane 11 as additional distortions are not mitigated from the drum 1. The plurality of dimples 23 accelerates the sound waves throughout the tuning port 2 from the intake end portion 24 to output end portion 26, creating more headroom and producing a deeper, richer, and fatter sound from the drum 1. In reference to FIG. 12-FIG. 13D, even though the plurality of dimples 23 is positioned throughout the inner surface 22, the exact positioning of the plurality of dimples 23 within the inner surface 22 can differ from one embodiment to another embodiment of the present invention. For example, in one embodiment of the present invention, the plurality of dimples 23 can be positioned only within the intake end portion 24. In another embodiment of the present invention, the plurality of dimples 23 can be positioned within the intake end portion 24, the central portion 25, and not on the output end portion 26 or any combination of thereof. The tuning port 2 may also be constructed without the plurality of dimples 23. The tuning port 2 can be made of plastic, polypropylene, abs, PVC, ceramic, and any other related materials, and the tuning port 2 can form into different color opaque forms, transparent form, and semi-transparent from. The tuning port 2 comprises several different sizes so that the tuning port 2 can seamlessly connect with the base drum, the floor tom drums, the snare drum, the timbales, and the hanging tom drums.

Figure 3:
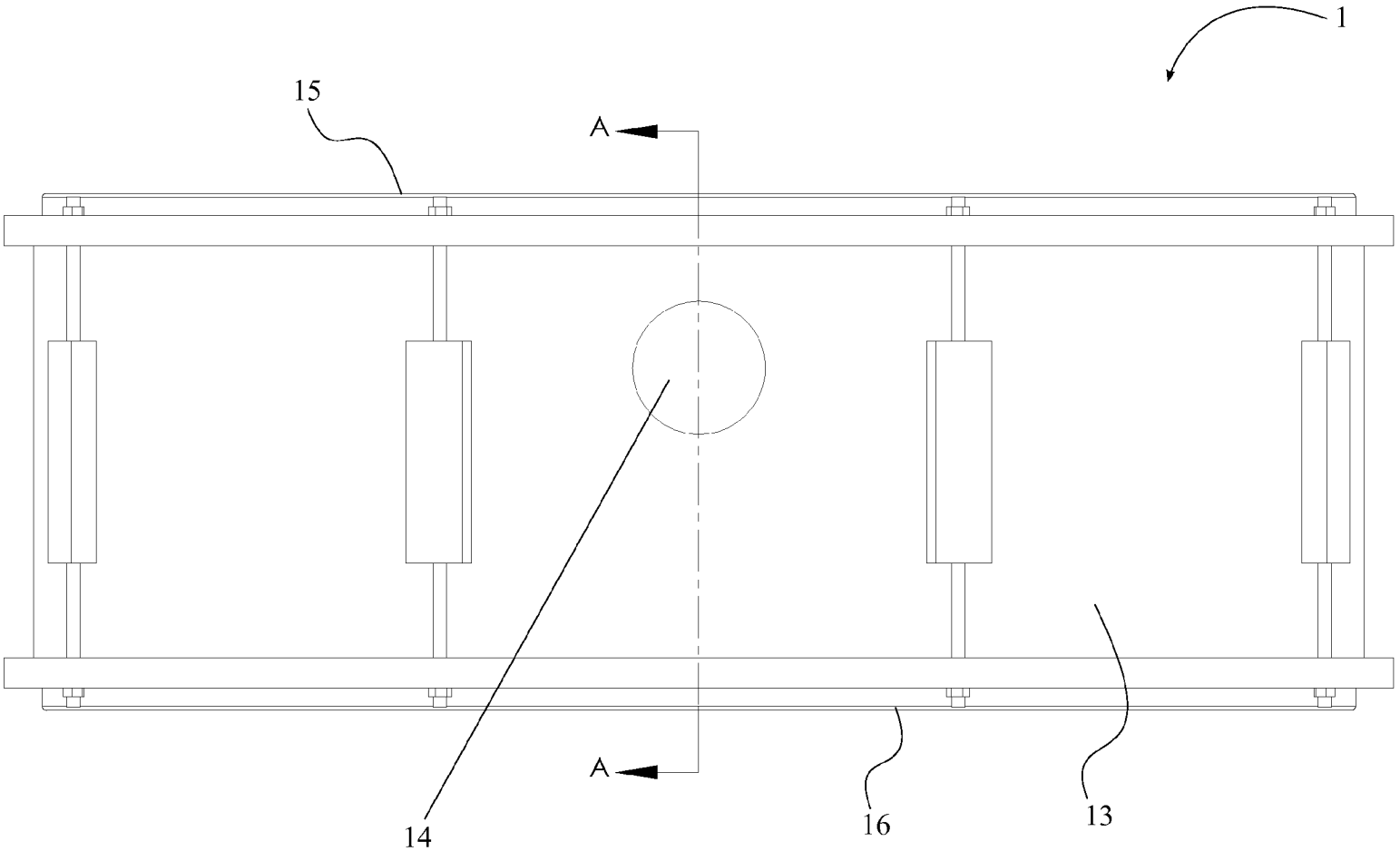
FIG. 3 is a front view of the drum of the present invention, showing the plane upon which a cross sectional view is taken shown in FIG. 4.
Figure 4:
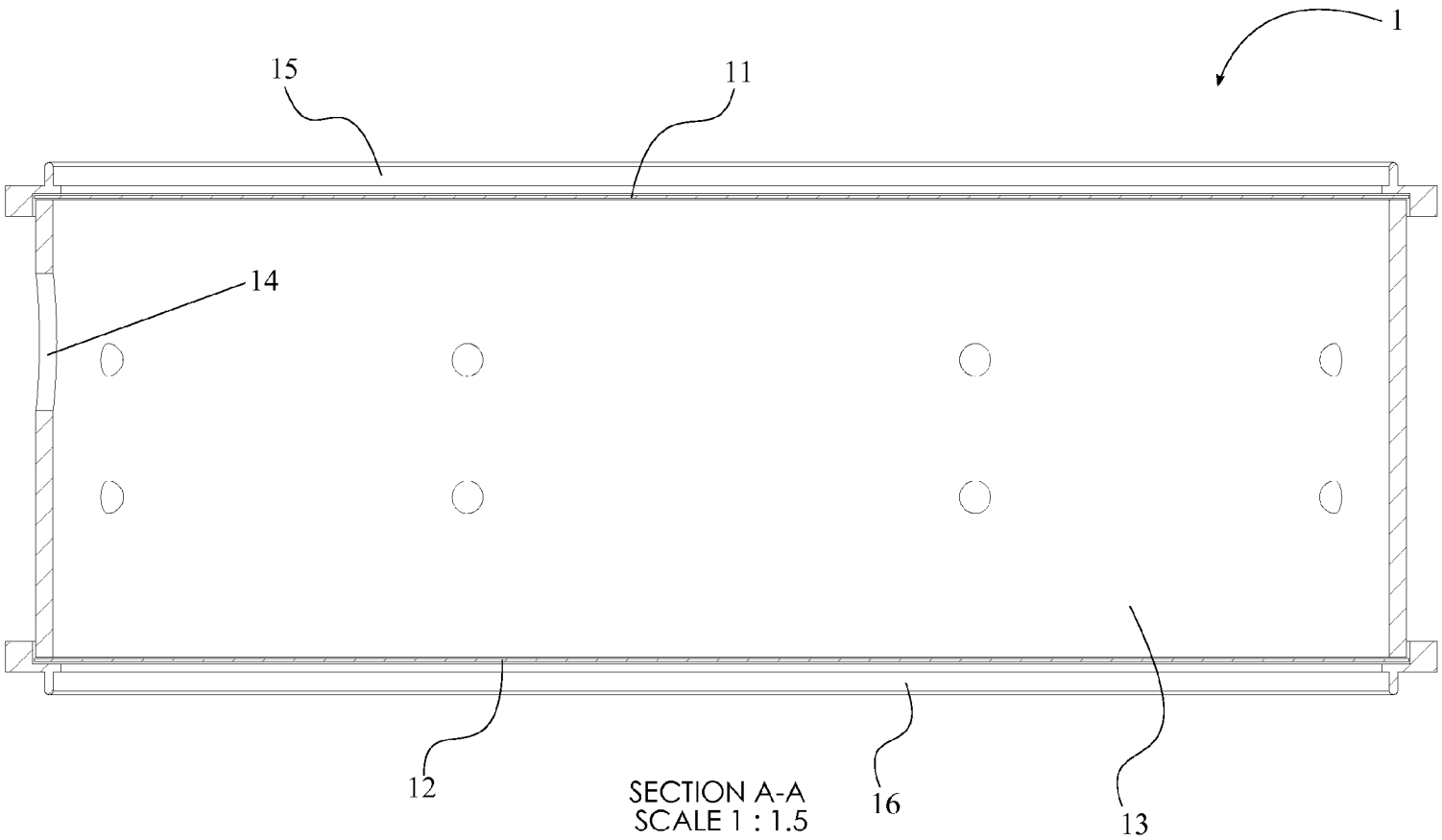
FIG. 4 is a cross section view of the drum of the present invention taken along the line A-A of FIG. 3.
Figure 5:
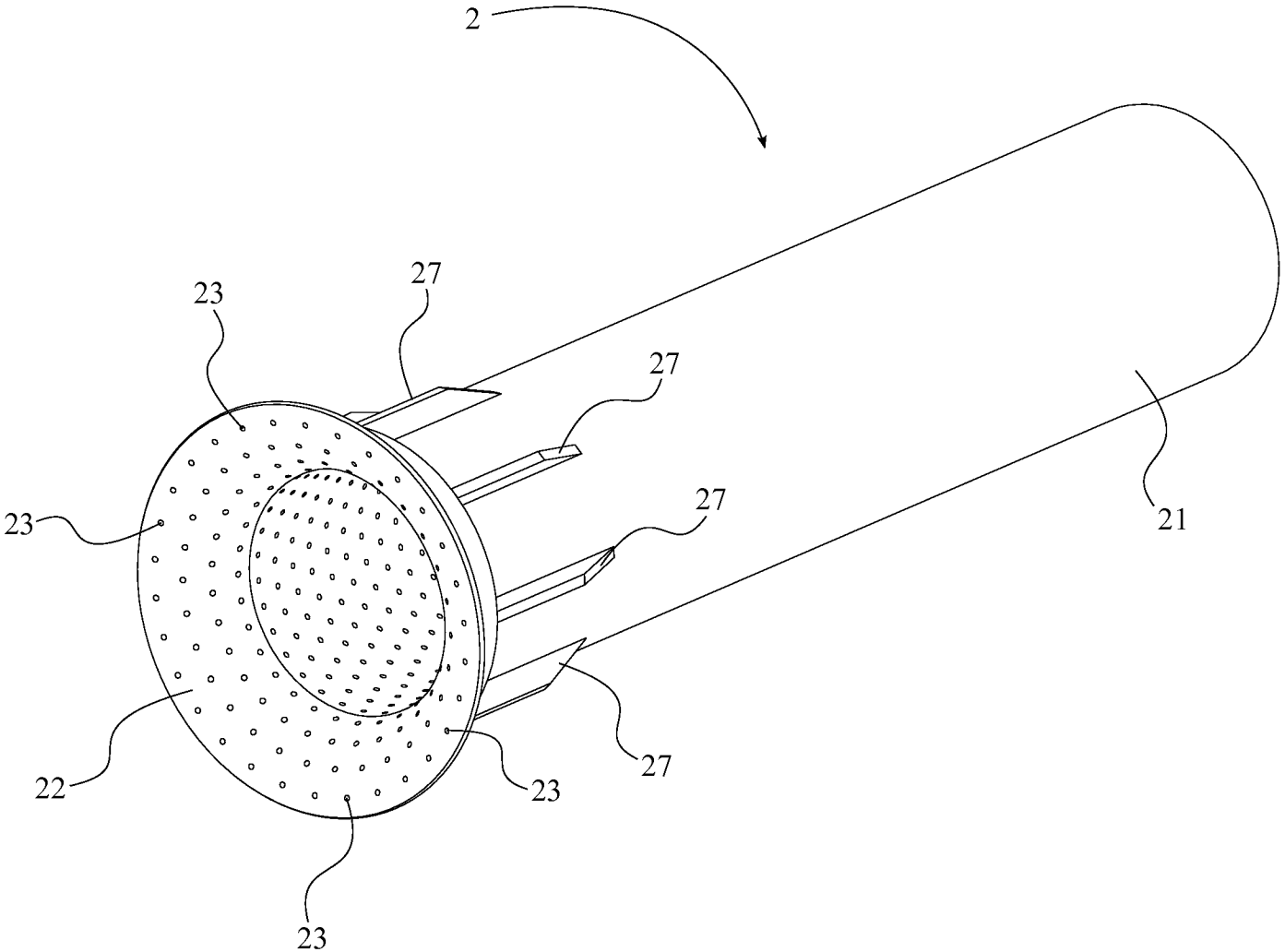
FIG. 5 is a perspective view of a first alternative embodiment of a tuning port of the present invention.
Figure 6:
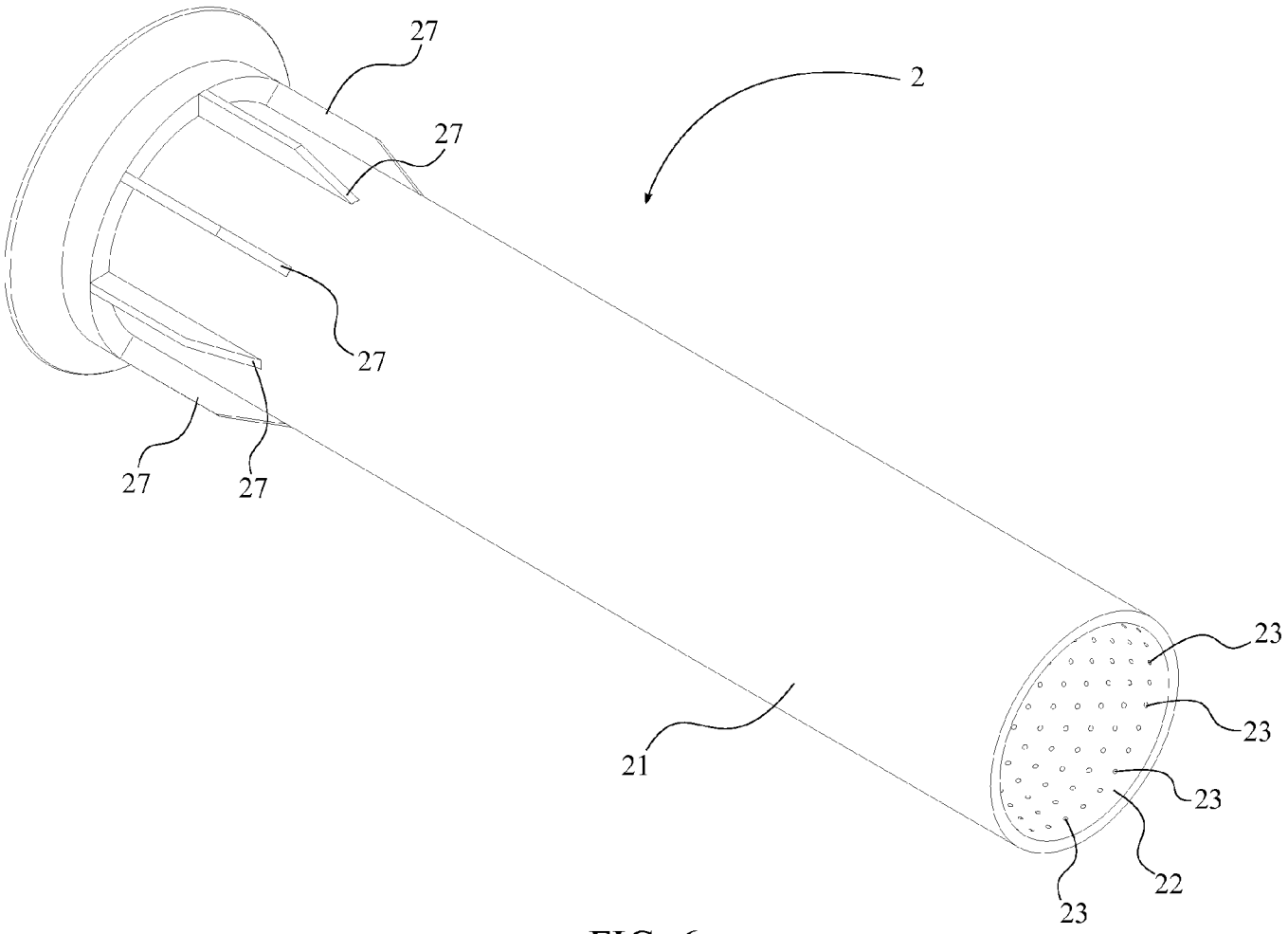
FIG. 6 is another perspective view of the first alternative embodiment of the tuning port of the present invention.
Figure 7:
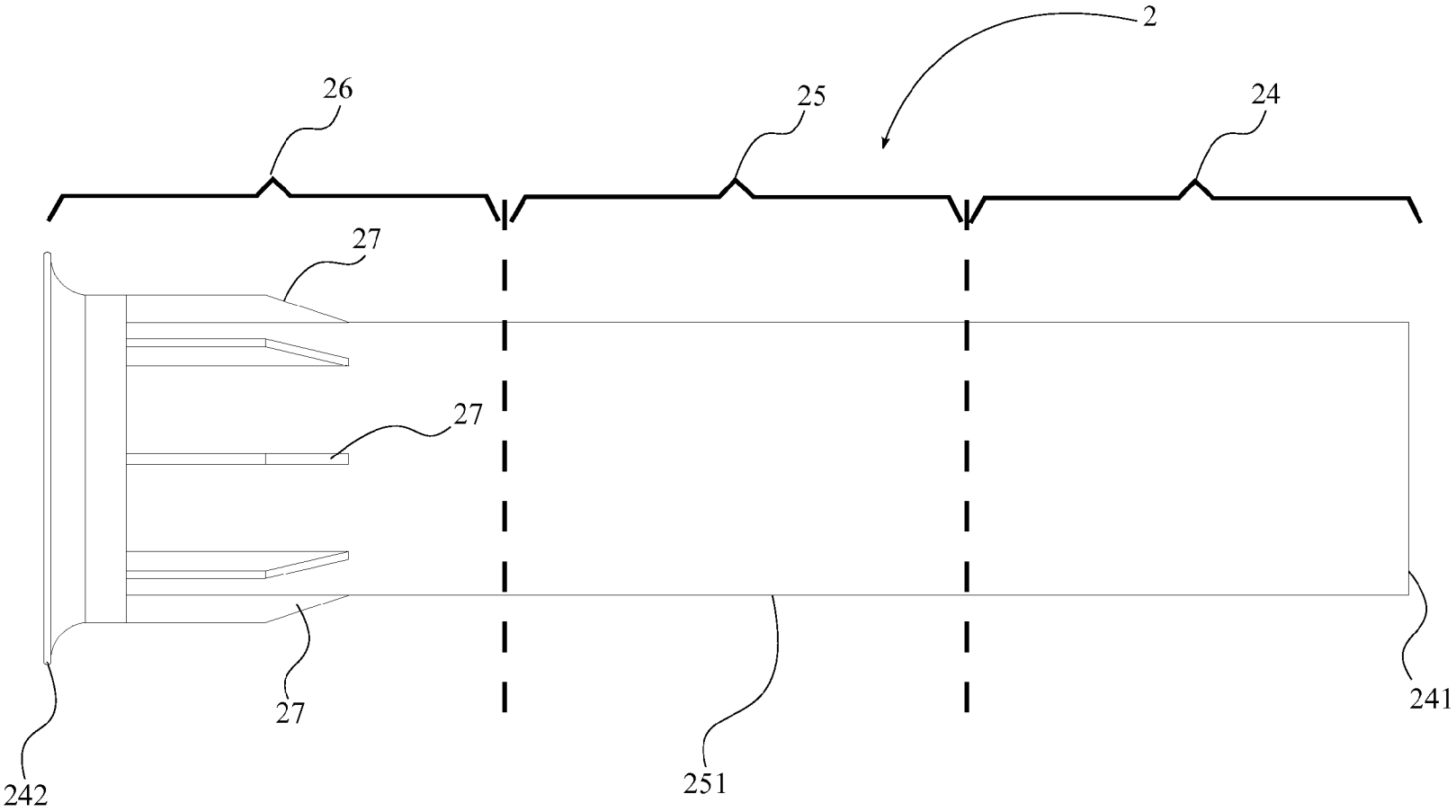
FIG. 7 is a side view of the first alternative embodiment of the tuning port of the present invention.
Figure 8:
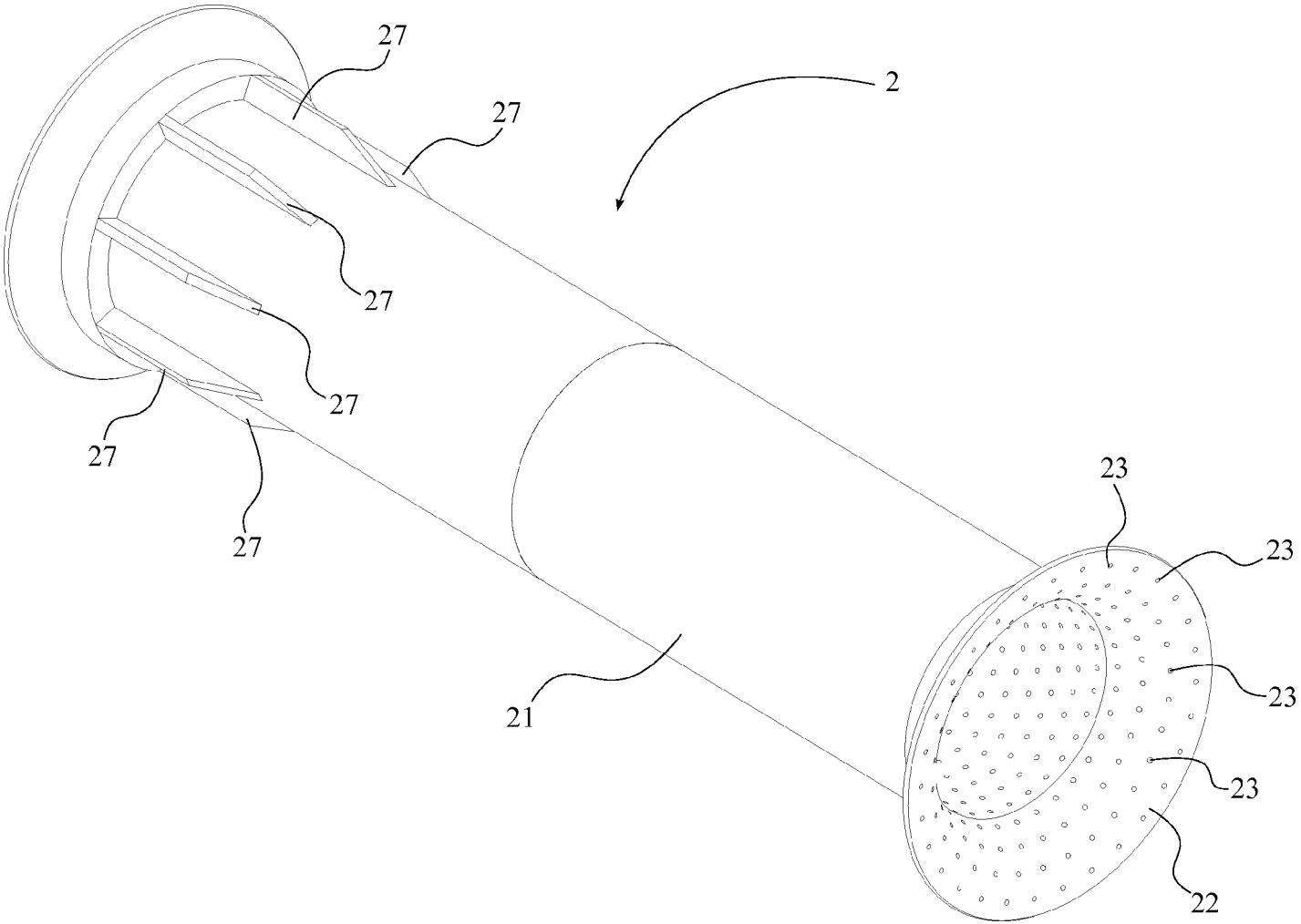
FIG. 8 is a perspective view of a second alternative embodiment of the tuning port of the present invention.
Figure 9:
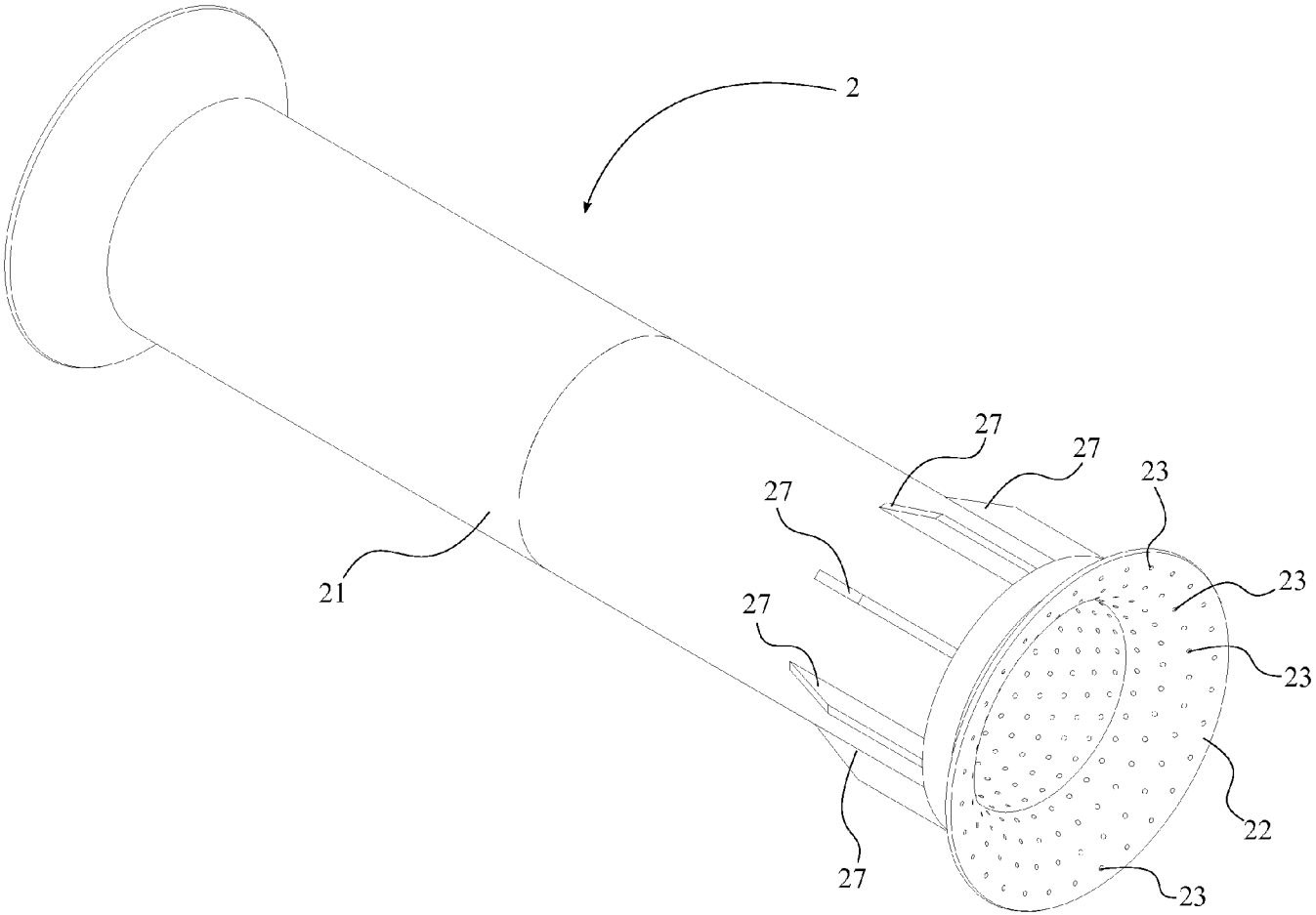
FIG. 9 is another perspective view of the second alternative embodiment of the tuning port of the present invention.
Figure 10:
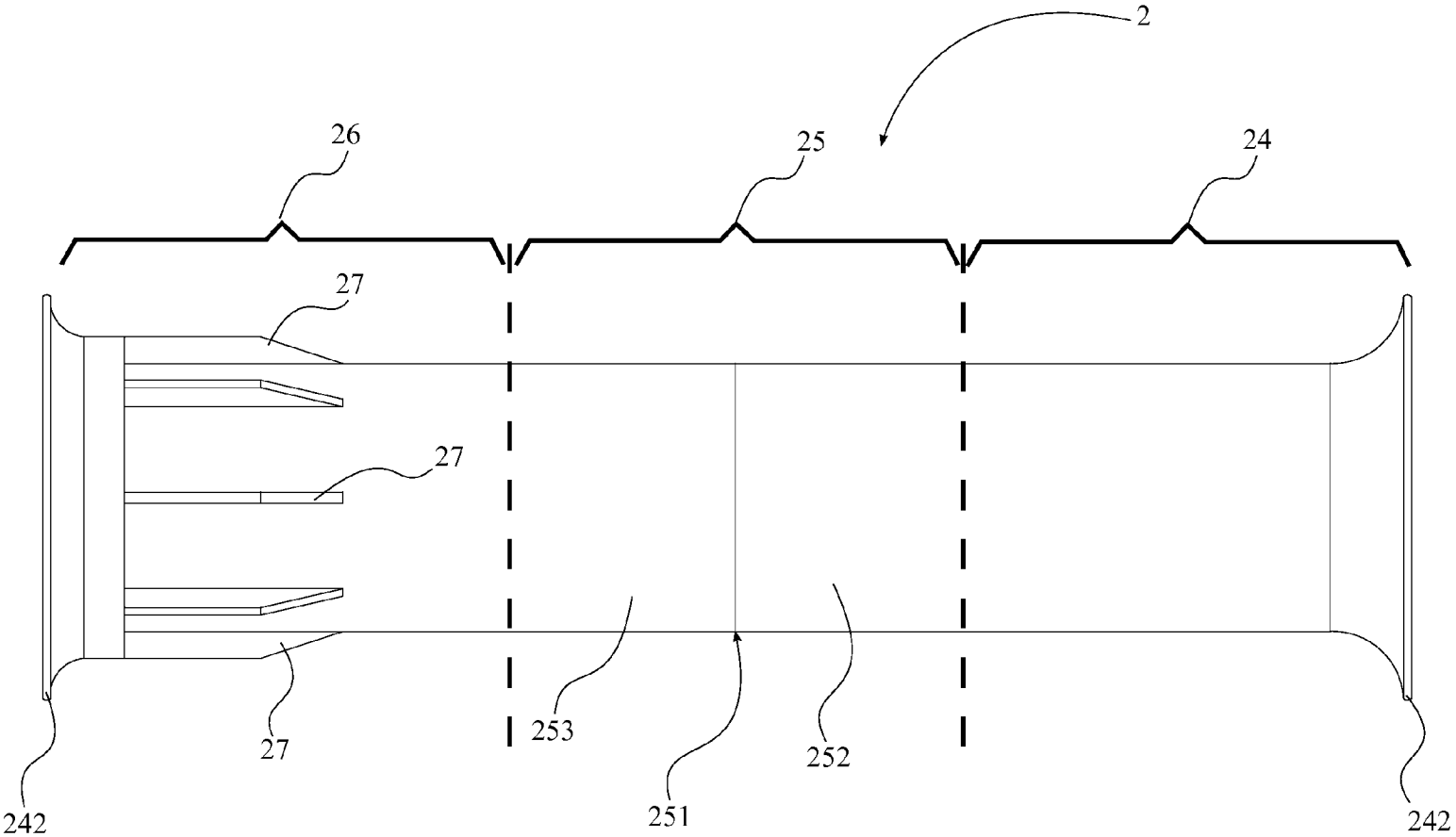
FIG. 10 is a side view of the second alternative embodiment of the tuning port of the present invention.
Figure 11:
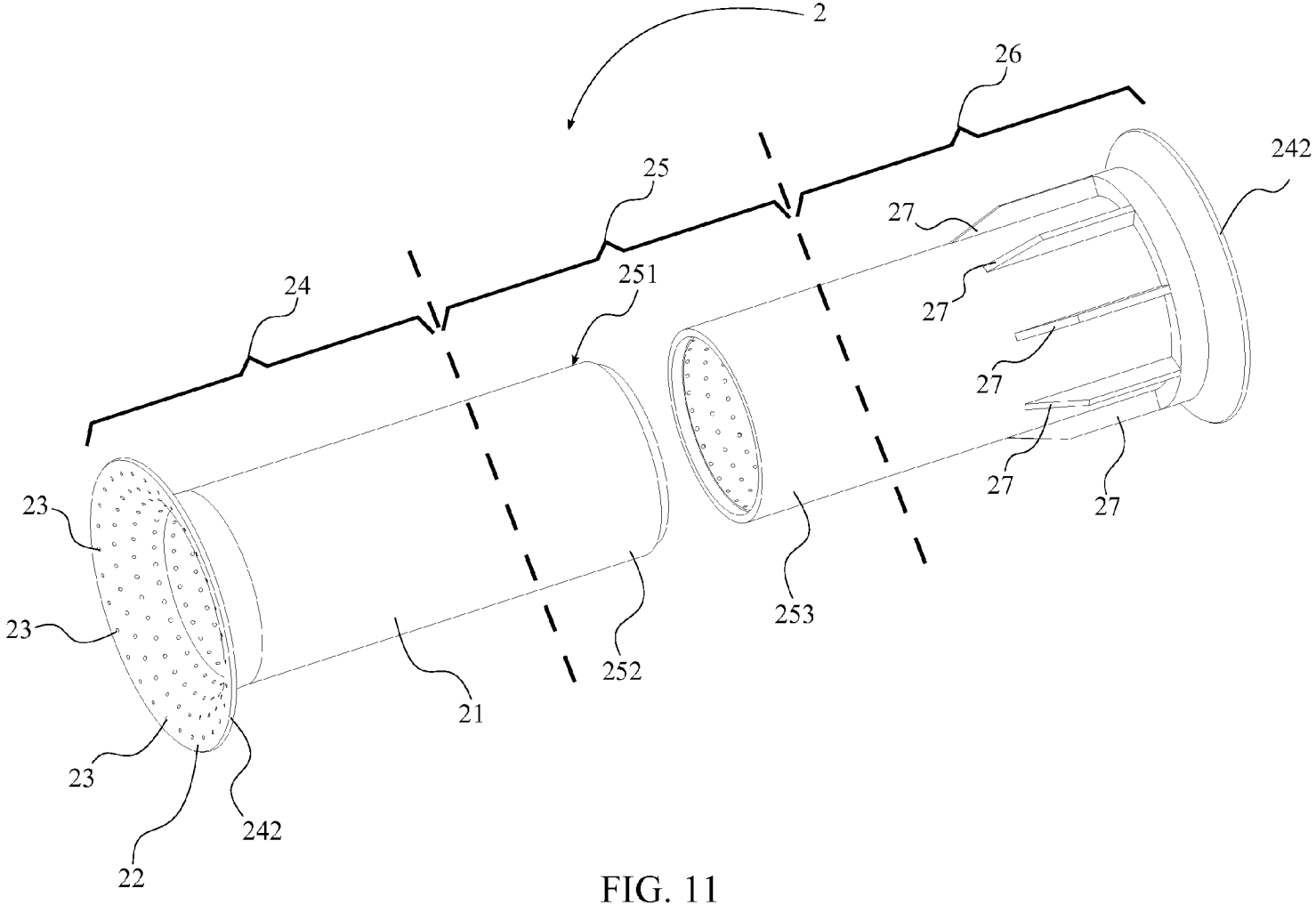
FIG. 11 is a view of the second alternative embodiment of the tuning port, wherein the second alternative embodiment is separated from a central portion.

In reference to FIG. 5, FIG. 6, and FIG. 7, a first alternative embodiment of the tuning port 2 comprises the outer surface 21, the inner surface 22, the plurality of dimples 23, the intake end portion 24, the central portion 25, the output end portion 26, and a plurality of locking protrusions 27. The plurality of locking protrusions 27 is positioned around the output end portion 26 and adjacently positioned with the outer surface 21. In the first alternative embodiment, the output end portion 26 is shaped into a flared end 242, and the intake end portion 24 is shaped into a cylindrical end 241. The central portion 25 comprises a cylindrical body 251 and linearly connects with both the output end portion 26 and the intake end portion 24. In order for the first alternative embodiment to attach with the drum 1, the drum shell 13 needs to comprise a cavity 14. As shown in FIG. 3 and FIG. 4, the cavity 14 is traversed through the drum shell 13 and positioned adjacent with the batter membrane 11. If the first alternative embodiment is attached with the traditional drums, the cavity 14 needs to be created within the drum shell of the traditional drum so that the first alternative embodiment can be attached.

Figure 14:
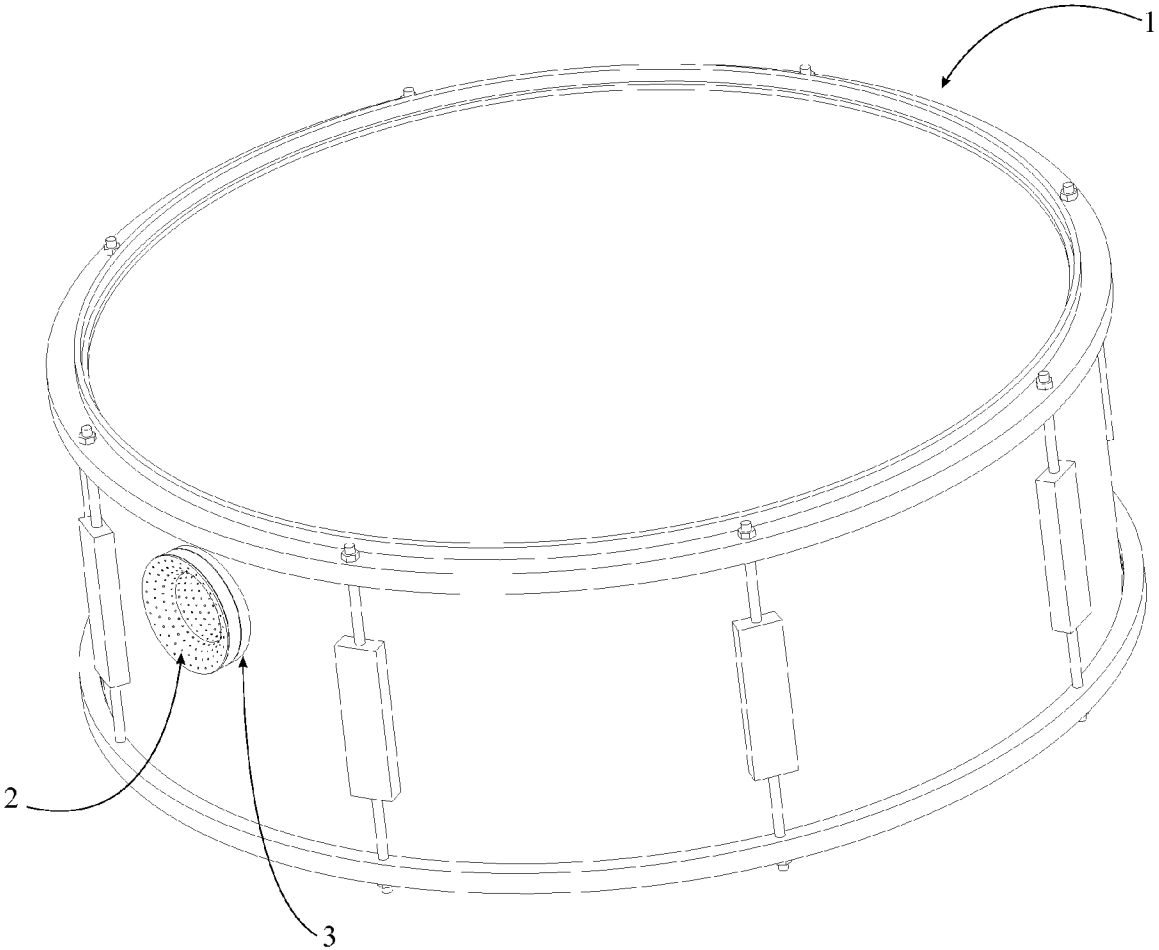
FIG. 14 is a perspective view of the first alternative embodiment, the drum, and a first attachment mechanism of the present invention.
Figure 16:
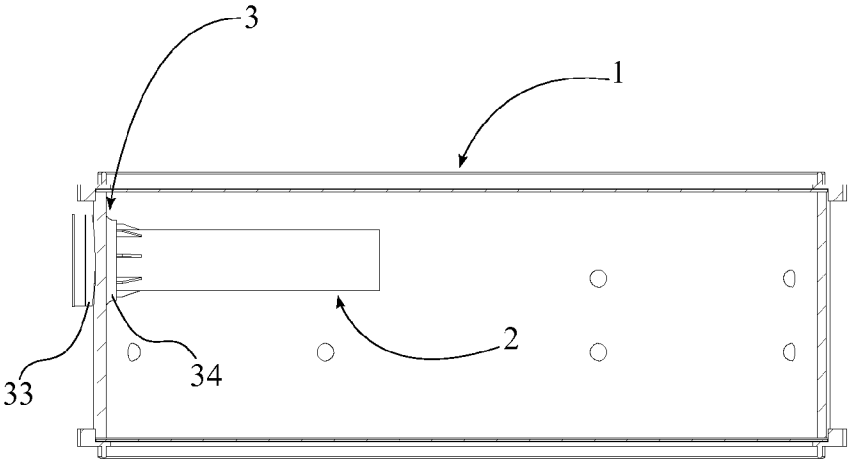
FIG. 16 is a cross section view of the first alternative embodiment, the drum, and the first attachment mechanism of the present invention taken along the line A-A of FIG. 15.
Figure 15:
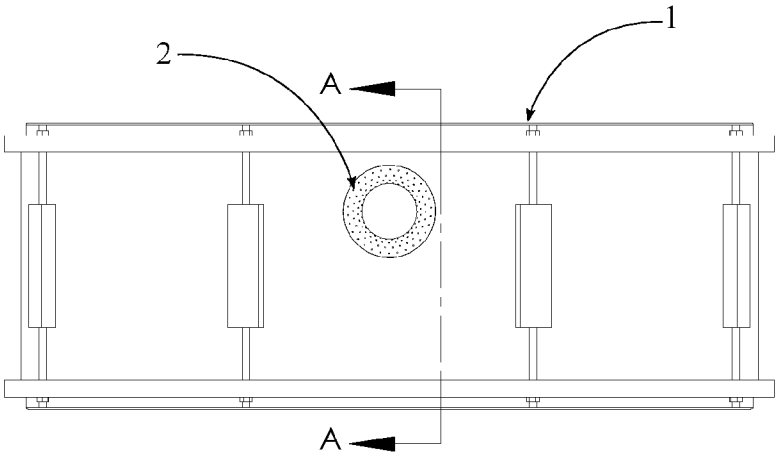
FIG. 15 is a front view of the first alternative embodiment, the drum, and the first attachment mechanism of the present invention, showing the plane upon which a cross sectional view is taken shown in FIG. 16.

The first alternative embodiment can be attached to the cavity 14 with a first attachment mechanism and a second attachment mechanism of the attachment mechanism 3. In reference to FIG. 14, FIG. 15, and FIG. 16, the first attachment mechanism comprises at least one gasket 33 and an attaching seal 34. In order to secure the first alternative embodiment, the at least one gasket 33 needs to be positioned around the output end portion 26. The at least one gasket 33 is inserted from the intake end portion 24 and adjacently positioned with the flared end 242 of the output end portion 26. Then the cylindrical end 241 of the intake end portion 24 is inserted into the cavity 14 until the at least one gasket 33 is positioned in between the flared end 242 of the output end portion 26 and the drum shell 13. The at least one gasket 33 can be made of, but not limited to, foam materials, rubber materials, and plastic materials, as the at least one gasket 33 fills any void areas in between the output end portion 26 and the drum shell 13. Then the attaching seal 34 is inserted within the drum shell 13 so that the first alternative embodiment can be attached with the drum shell 13 through the first attachment mechanism, where the attaching seal 34 is positioned around the plurality of locking protrusions 27. The attaching seal 34 is adjacently positioned with the cavity 14 and the drum shell 13 securing the first alternative embodiment.

Figure 17:
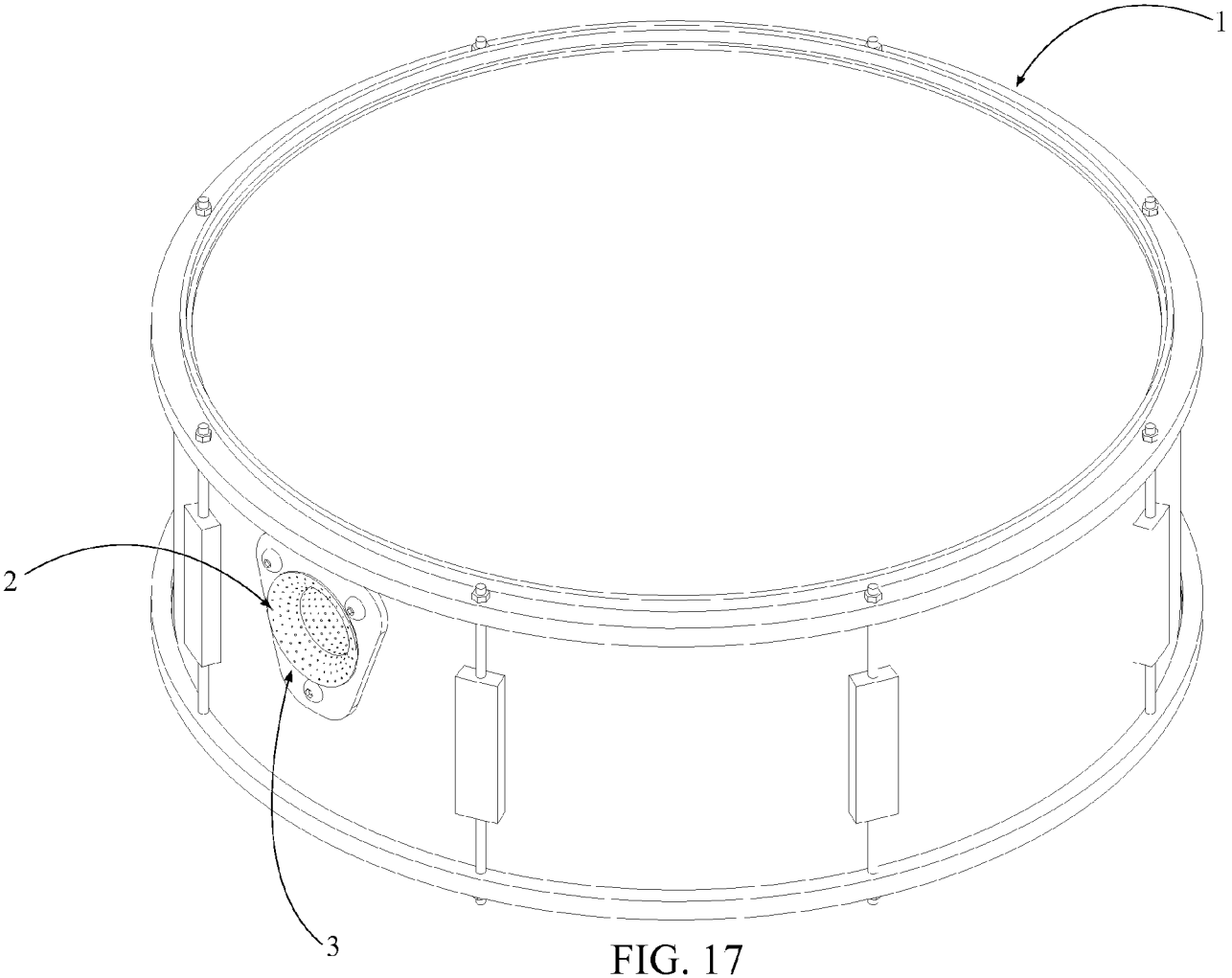
FIG. 17 is a perspective view of the first alternative embodiment, the drum, and a second attachment mechanism of the present invention.
Figure 19:
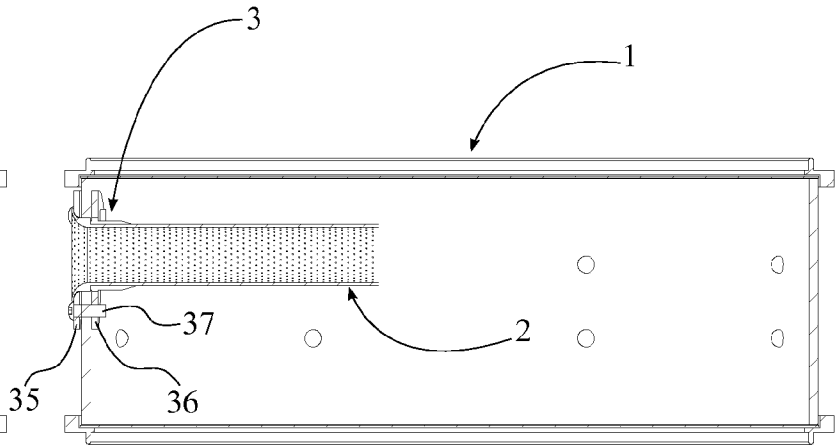
FIG. 19 is a cross section view of the first alternative embodiment, the drum, and the second attachment mechanism of the present invention taken along the line C-C of FIG. 18.
Figure 18:
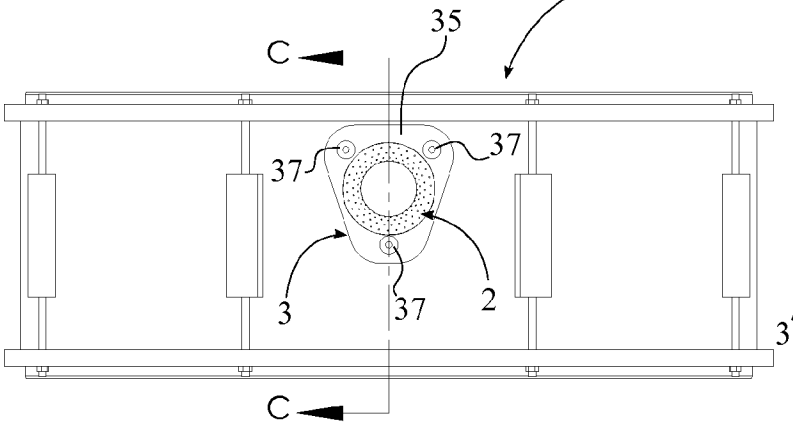
FIG. 18 is a front view of the first alternative embodiment, the drum, and the second attachment mechanism of the present invention, showing the plane upon which a cross sectional view is taken shown in FIG. 19.

In reference to FIG. 17, FIG. 18, and FIG. 19, the second attachment mechanism comprises an external plate 35, an internal plate 36, and a plurality of attachments 37. In order to secure the first alternative embodiment, the external plate 35 needs to be positioned around the output end portion 26. The external plate 35 is inserted from the intake end portion 24 and adjacently positioned with the flared end 242 of the output end portion 26. Then the cylindrical end 241 of intake end portion 24 is inserted into the cavity 14 unit the external plate 35 is positioned in between the flared end 242 of the output end portion 26 and the drum shell 13. Then the internal plate 36 is inserted within the drum shell 13 so that the first alternative embodiment can be attached with the drum shell 13 by the plurality of attachments 37. More specifically, the internal plate 36 is positioned around the plurality of locking protrusions 27 with adjacent to the cavity 14, where the plurality of attachments 37 is traversed through the external plate 35, the drum shell 13, and the internal plate 36. The plurality of attachments 37 includes, but not limited to, screws, bolts and nuts, rivets, and clips. The external plate 35 and the internal plate 36 are preferably made from aluminum or plastic, as the aluminum or plastic produces less sympathetic vibration and do not interfere with the natural tones of the drum 1. Even though the external plate 35 and the internal plate 36 are made of aluminum, they can be made from any other materials as long as the materials do not interfere with the natural tones of the drum 1.

In reference to FIG. 8-FIG. 11, a second alternative embodiment of the tuning port 2 comprises the outer surface 21, the inner surface 22, the plurality of dimples 23, the intake end portion 24, the central portion 25, the output end portion 26, and a plurality of locking protrusions 27. Similar to the first embodiment, the plurality of locking protrusions 27 is positioned around the output end portion 26 and adjacently positioned with the outer surface 21. In the second alternative embodiment, the output end portion 26 and the intake end portion 24 are shaped into a flared end 242. The central portion 25 comprises the cylindrical body 251 and linearly connects with both the output end portion 26 and the intake end portion 24. More specifically, the central portion 25 comprises an intake tube section 252 and an output tube section 253. The intake tube section 252 is adjacently connected with the intake end portion 24, and the output tube section 253 is adjacently connected with the output end portion 26, where the intake tube section 252 and the output tube section 253 are removably attached to each other through a fastening mechanism such as a male and female locking system, magnetic locking system, and snap locking system.

Figure 20:
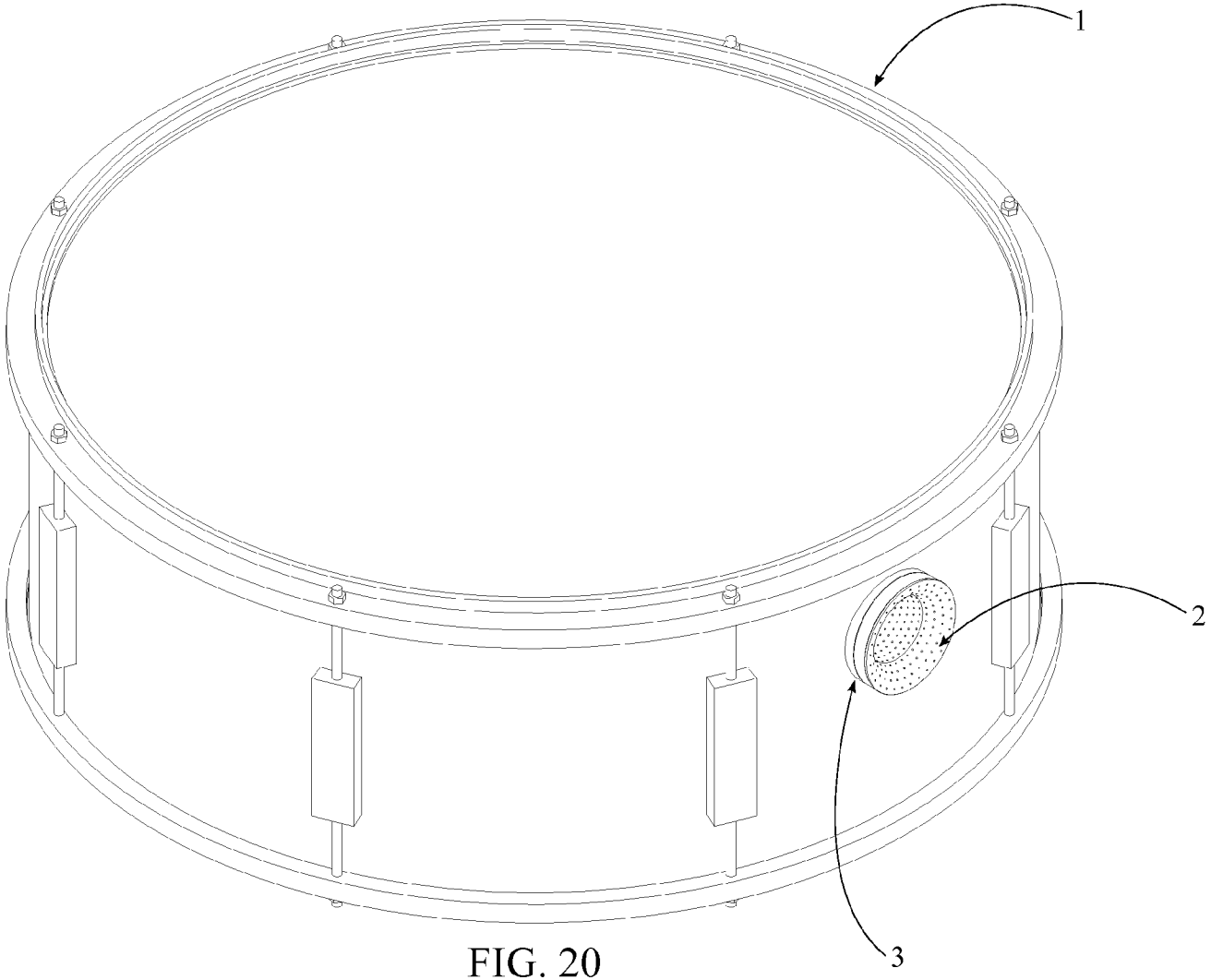
FIG. 20 is a perspective view of the second alternative embodiment, the drum, and the first attachment mechanism of the present invention.
Figure 22:
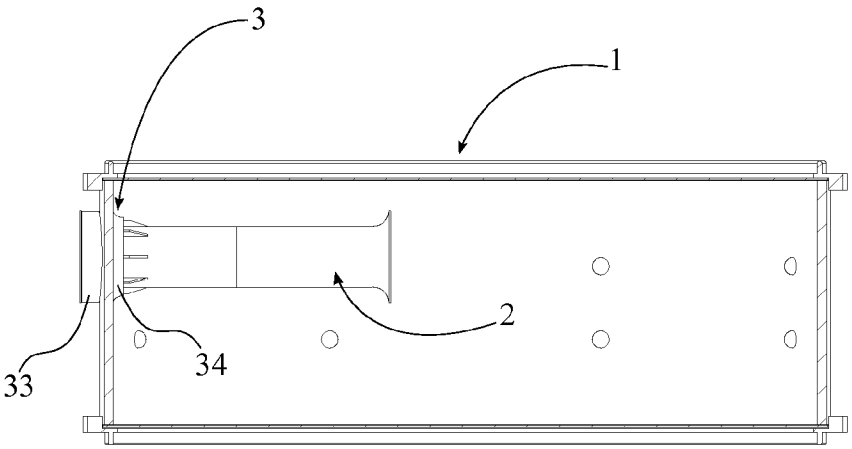
FIG. 22 is a cross section view of the second alternative embodiment, the drum, and the first attachment mechanism of the present invention taken along the line A-A of FIG. 21.
Figure 21:
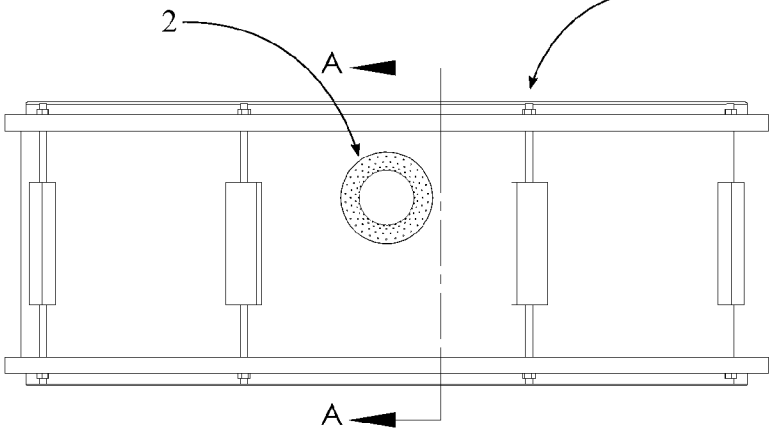
FIG. 21 is a front view of the second alternative embodiment, the drum, and the first attachment mechanism of the present invention, showing the plane upon which a cross sectional view is taken shown in FIG. 22.

In reference to FIG. 20, FIG. 21, and FIG. 22, the second alternative embodiment can also be attached to the cavity 14 with the first attachment mechanism and the second attachment mechanism. In order to secure the second alternative embodiment, the at least one gasket 33 needs to be positioned around the output end portion 26. The at least one gasket 33 is inserted from the output tube section 253 and adjacently positioned with the flared end 242 of the output end portion 26. Then the output tube section 253 is inserted into the cavity 14 until the at least one gasket 33 is positioned in between the flared end 242 of the output end portion 26 and the drum shell 13. Then the attaching seal 34 is inserted within the drum shell 13 so that the output tube section 253 and the output end portion 26 can be attached with the drum shell 13 from the first attachment mechanism, where the attaching seal 34 is positioned around the plurality of locking protrusions 27 and adjacently positioned with the cavity 14. Then the intake tube section 252 is removably attached with the output tube section 253 within the drum shell 13, completing the second alternative embodiment.

Figure 23:
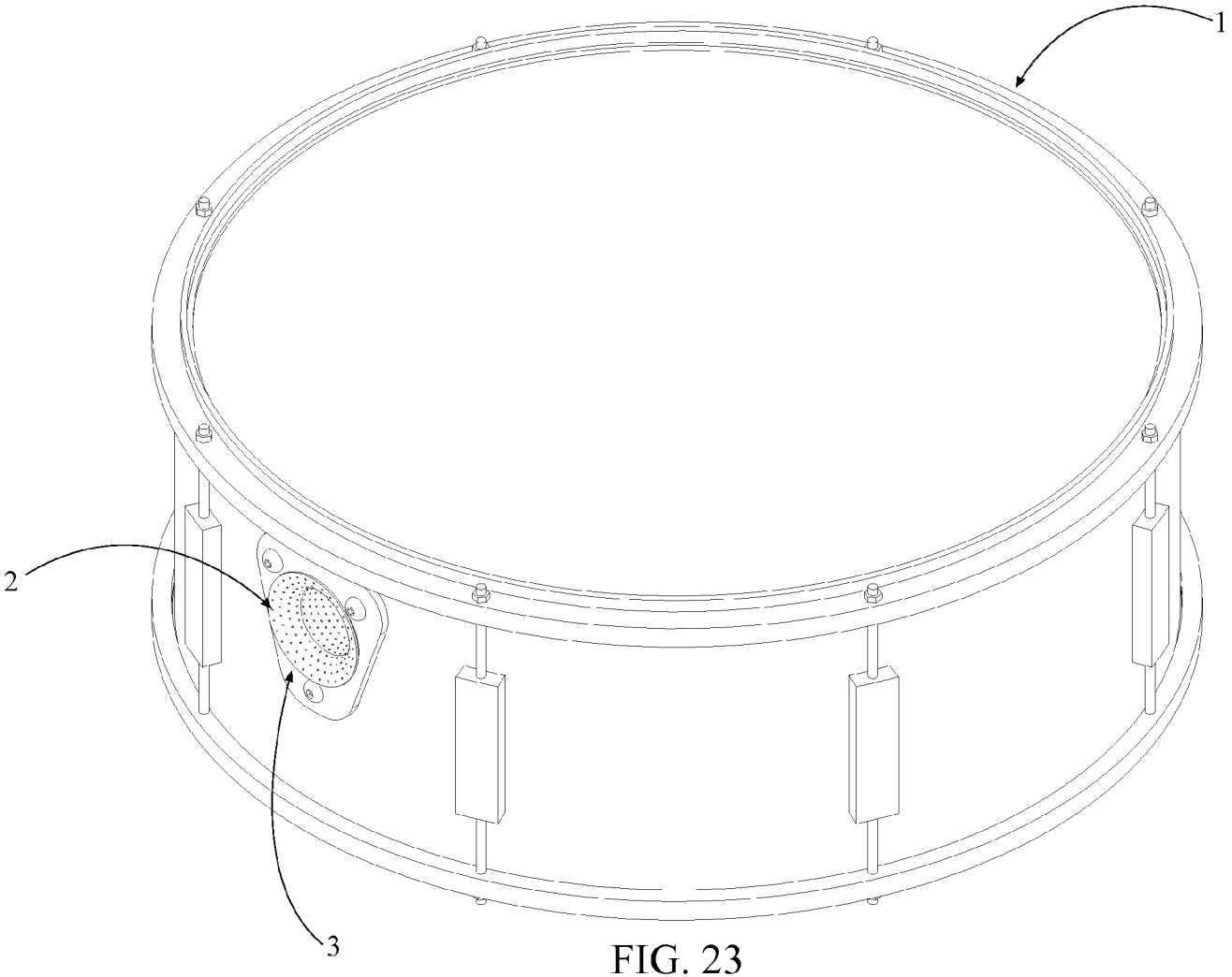
FIG. 23 is a perspective view of the second alternative embodiment, the drum, and the second attachment mechanism of the present invention.
Figure 25:
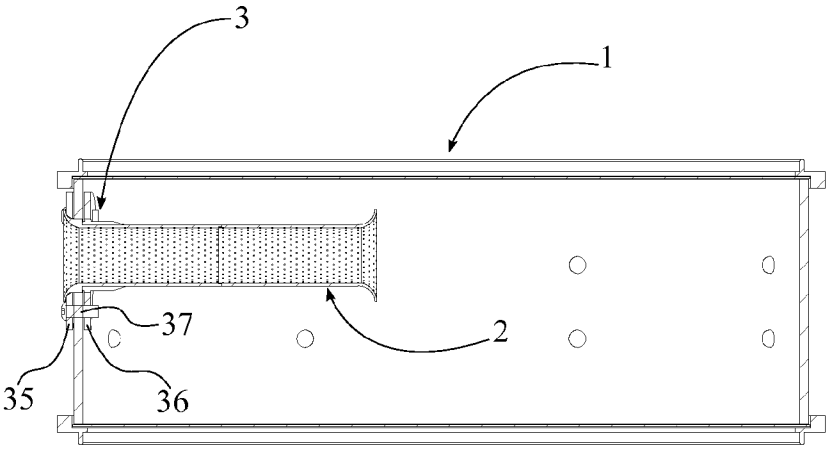
FIG. 25 is a cross section view of the second alternative embodiment, the drum, and the second attachment mechanism of the present invention taken along the line A-A of FIG. 24.
Figure 24:
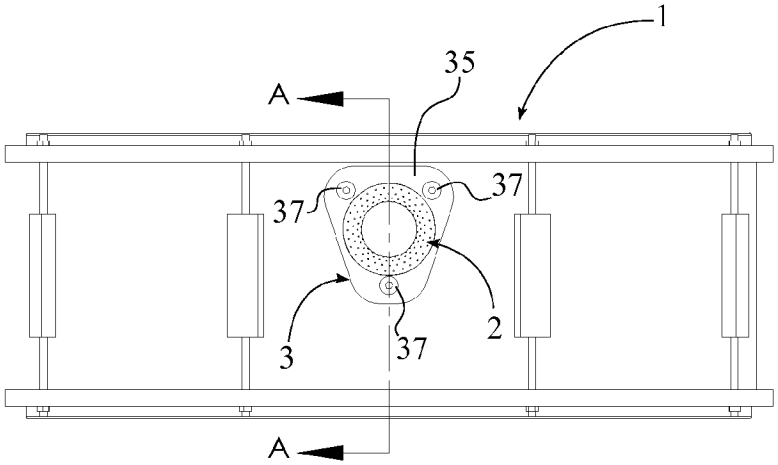
FIG. 24 is a front view of the second alternative embodiment, the drum, and the second attachment mechanism of the present invention, showing the plane upon which a cross sectional view is taken shown in FIG. 25.

As shown in FIG. 23, FIG. 24, and FIG. 25, in order to secure the second alternative embodiment through the second attachment mechanism, the external plate 35 needs to be positioned around the output end portion 26. The external plate 35 is inserted from the output tube section 253 and adjacently positioned with the flared end 242 of the output end portion 26. Then output tube section 253 of the central portion 25 is inserted into the cavity 14 until the external plate 35 is positioned in between the flared end 242 of the output end portion 26 and the drum shell 13. Then the internal plate 36 is inserted within the drum shell 13 so that the output end portion 26 and the output tube section 253 can be attached with the drum shell 13 by the plurality of attachments 37. More specifically, the internal plate 36 is positioned around the plurality of locking protrusions 27 and adjacent to the cavity 14, where the plurality of attachments 37 is traversed through the external plate 35, the drum shell 13, and the internal plate 36. The plurality of attachments 37 includes, but not limited to, screws, bolts and nuts, rivets, and clips. Then the intake tube section 252 is removably attached with the output tube section 253 within the drum shell 13, completing the second alternative embodiment.

Even though the second attachment mechanism conjunctionally uses the external plate 35 and the internal plate 36 with the plurality of attachments 37, the external plate 35 or the internal plate 36 can be individually used with the plurality of attachments 37. Then the plurality of attachments 37 is traversed through either the internal plate 36 or the external plate 35 and connects with the drum shell 13. The second attachment mechanism may also use additional gaskets and seals in order to properly secure the tuning port 2 with the drum 1.

Figure 12:
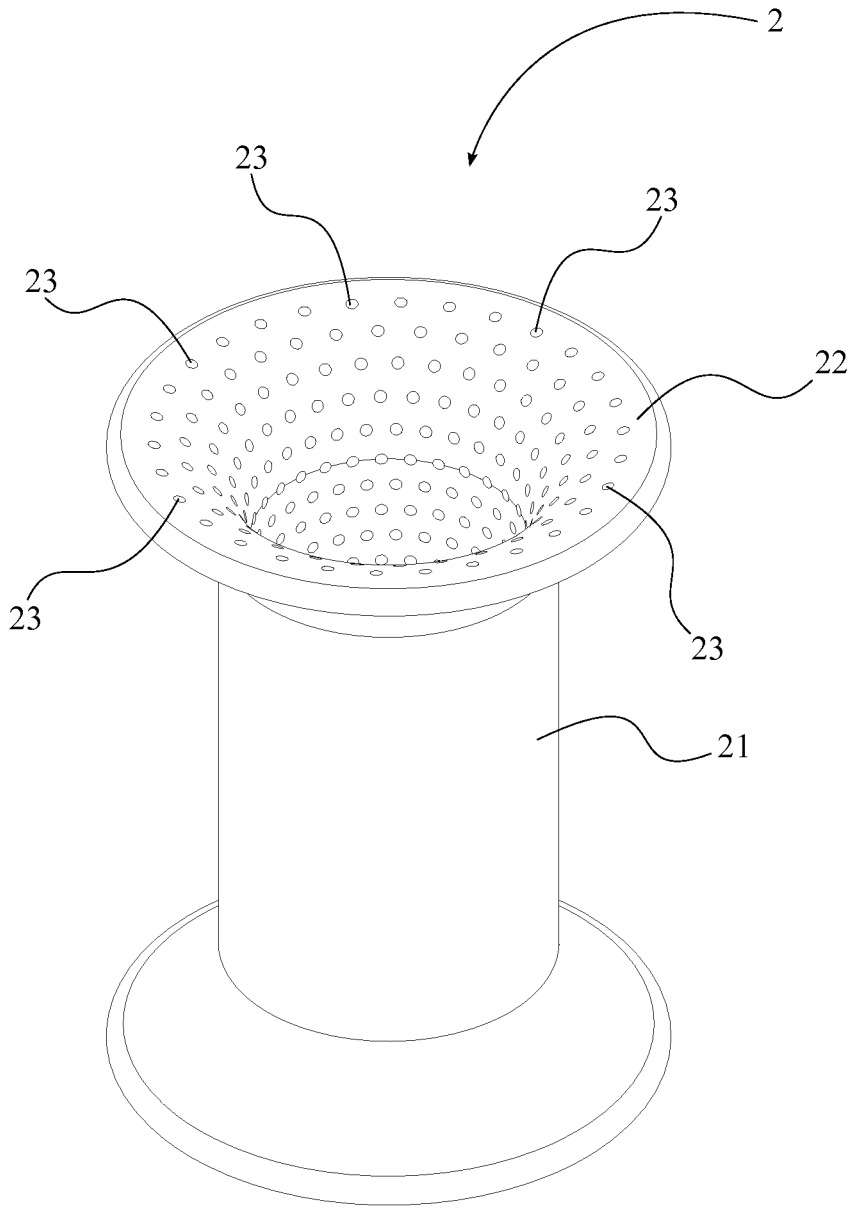
FIG. 12 is a perspective view of a third alternative embodiment of the tuning port of the present invention.
Figure 13A:
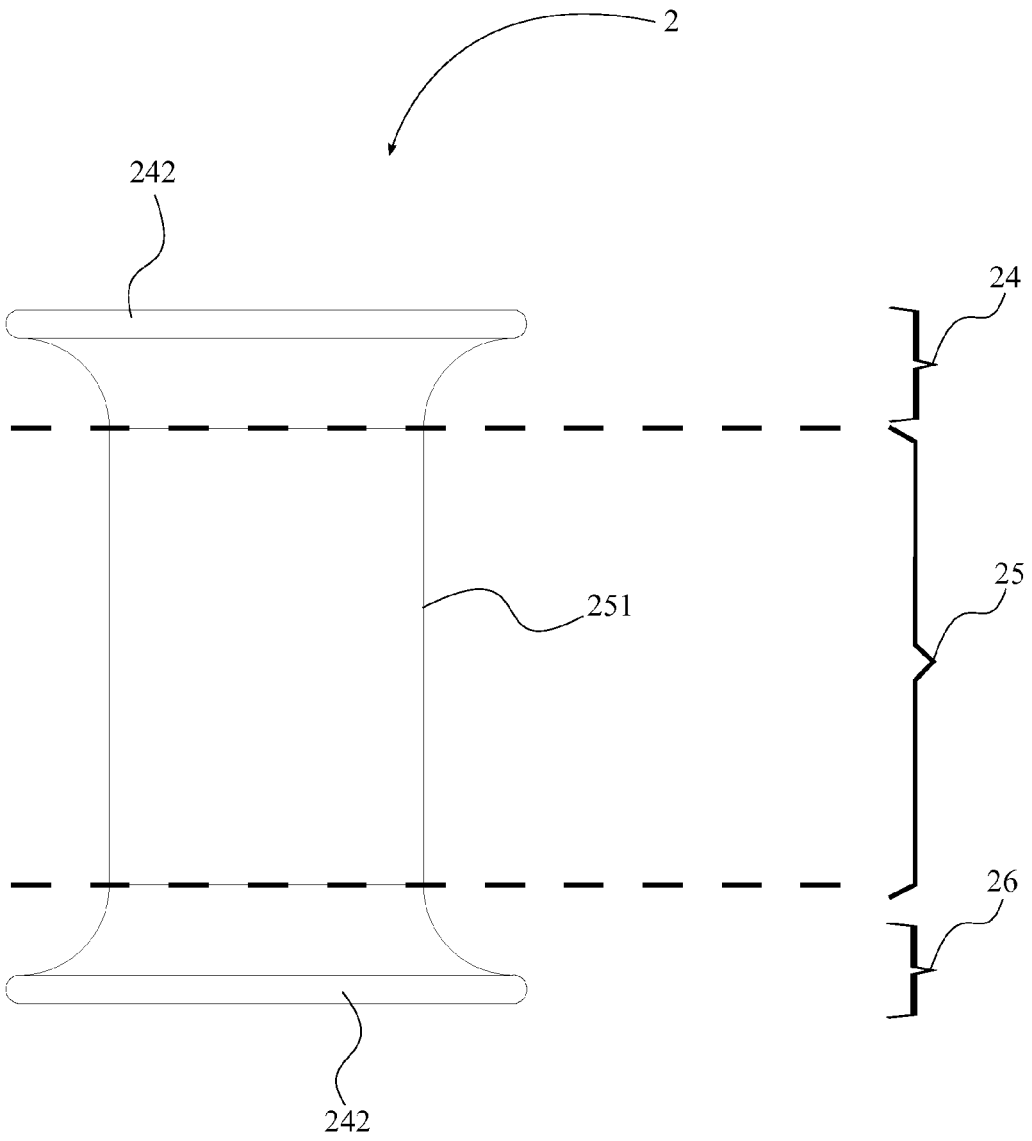
FIG. 13A is a side view of the third alternative embodiment of the tuning port of the present invention.
Figure 13B:
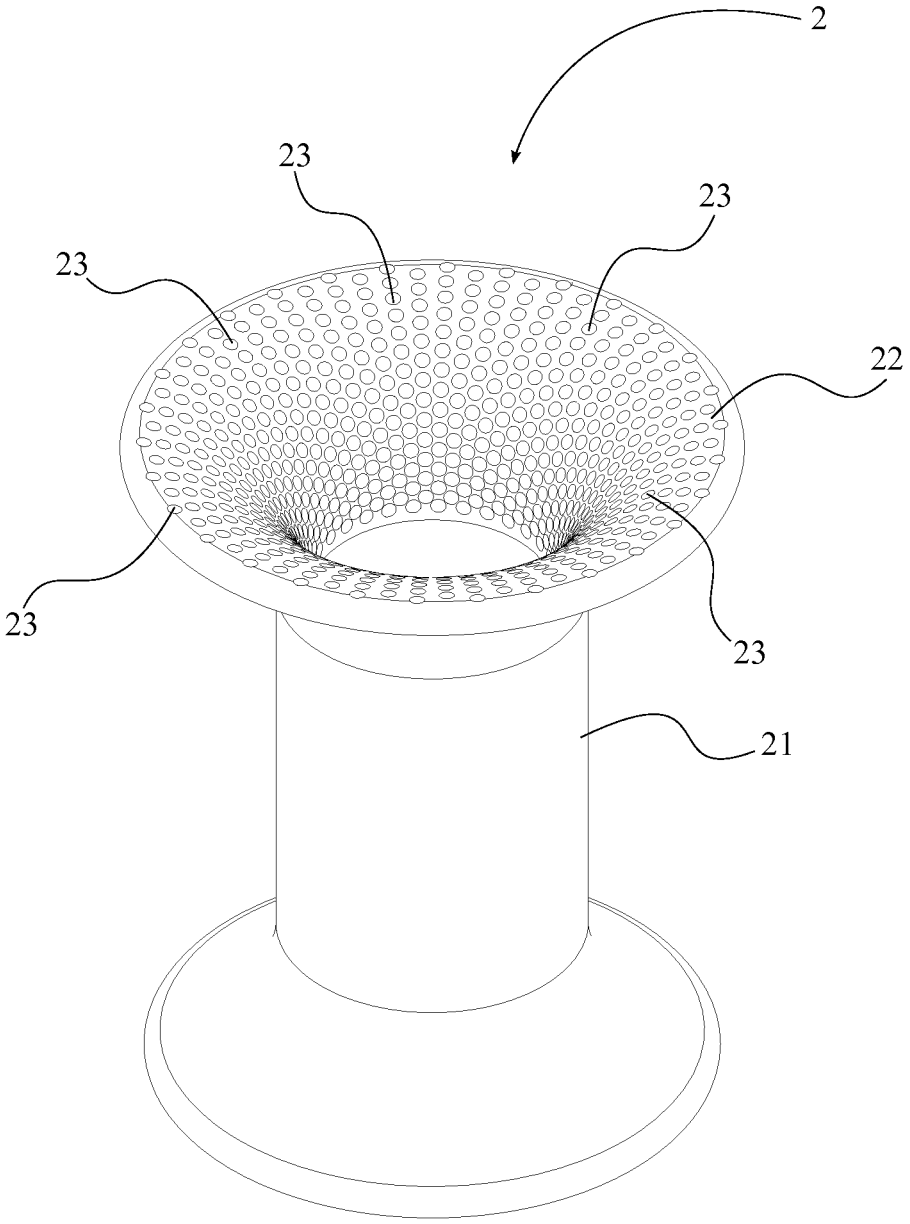
FIG. 13B is a perspective view of the third alternative embodiment of the tuning port of the present invention, showing the plurality of dimples only in the intake end portion.
Figure 13C:
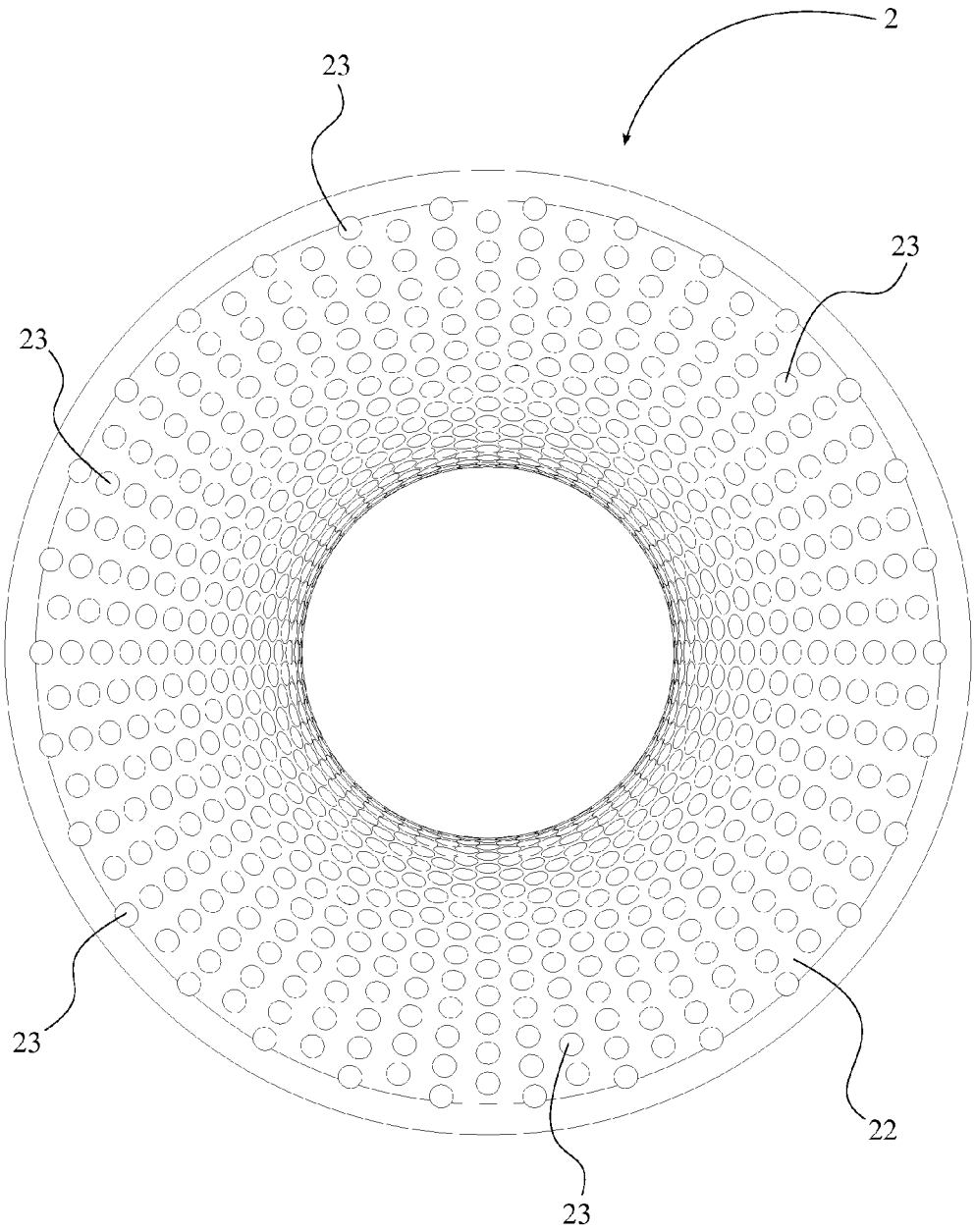
FIG. 13C is top view of the third alternative embodiment of the tuning port of the present invention, showing the plurality of dimples only in the intake end portion.
Figure 13D:
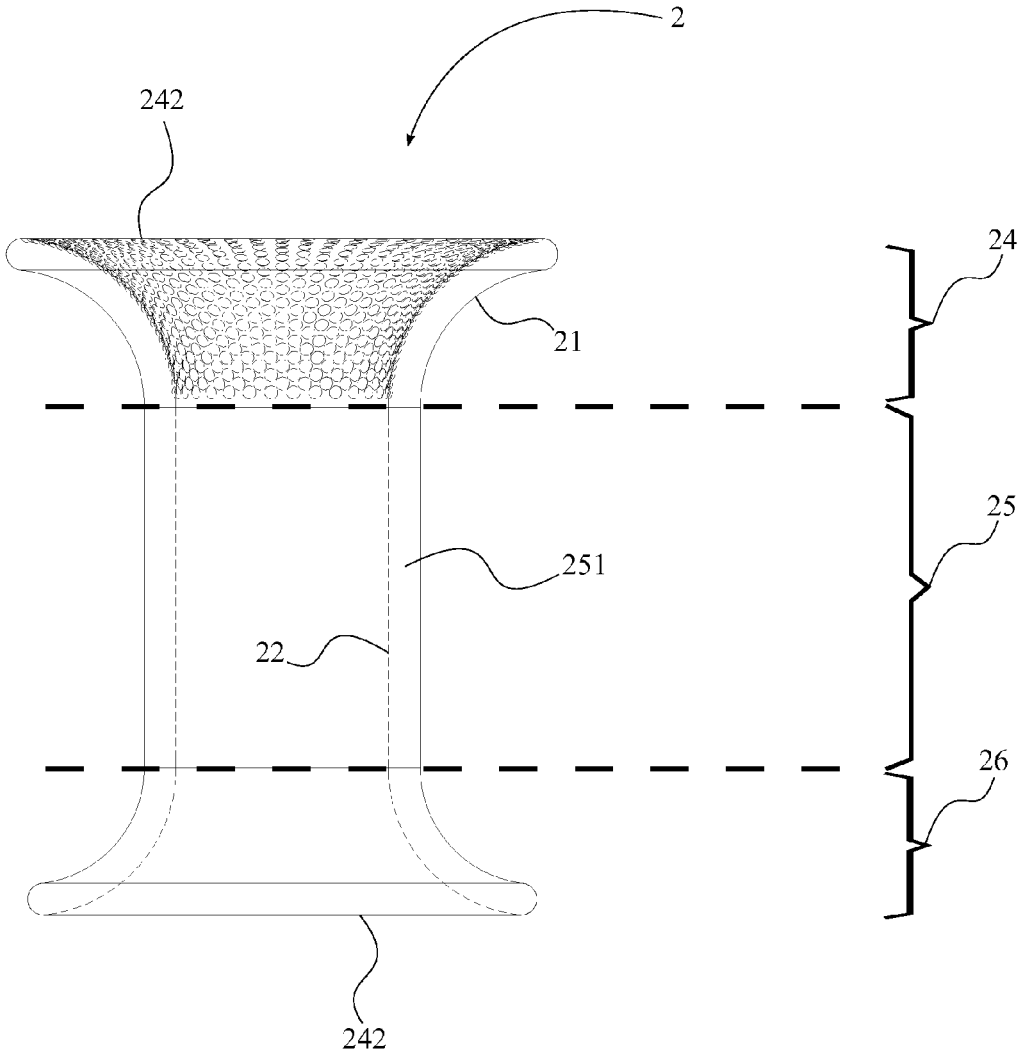
FIG. 13D is a side view of the third alternative embodiment of the tuning port of the present invention, showing the inner surface and the plurality of dimples only in the intake end portion.

In reference to FIG. 12 and FIG. 13, a third alternative embodiment of the tuning port 2 comprises the outer surface 21, the inner surface 22, the plurality of dimples 23, the intake end portion 24, the central portion 25, and the output end portion 26. In the third alternative embodiment, the output end portion 26 and the intake end portion 24 are shaped into a flared end 242. The central portion 25 comprises a cylindrical body 251 and linearly positions with both the output end portion 26 and the intake end portion 24.

Figure 26:
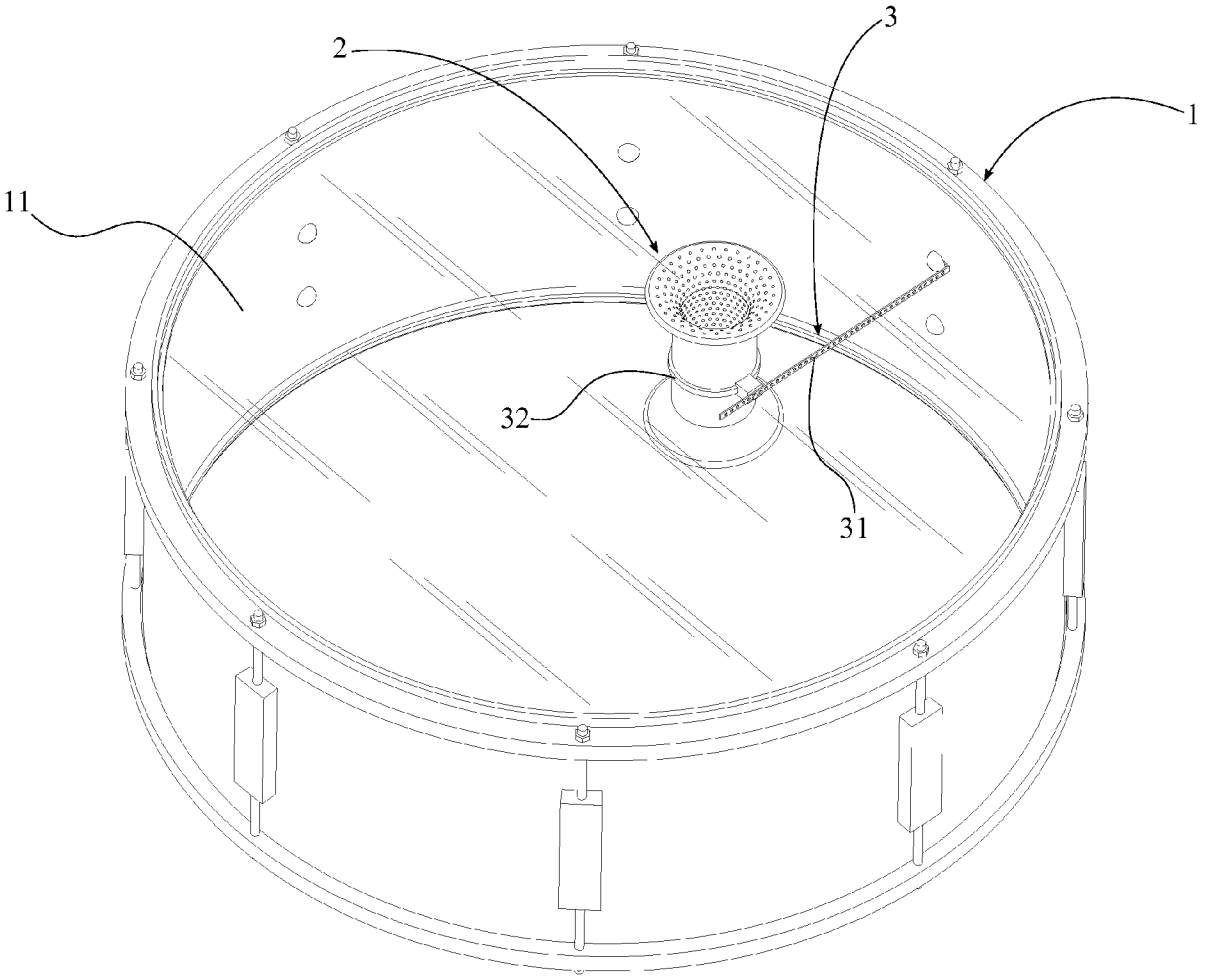
FIG. 26 is a perspective view of the third alternative embodiment, the drum, and a third attachment mechanism of the present invention.
Figure 28:
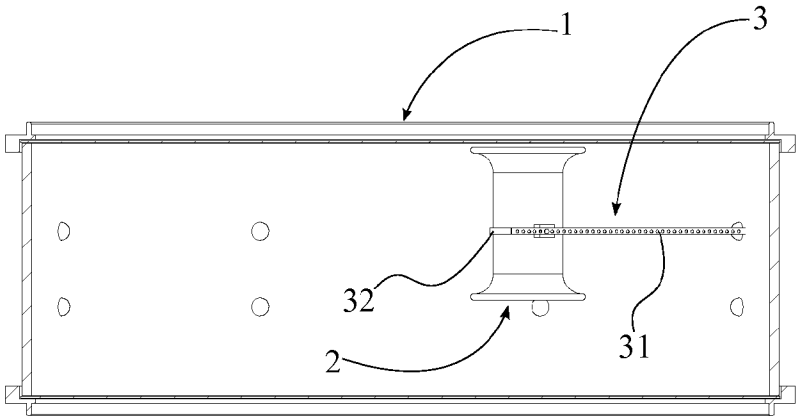
FIG. 28 is a cross section view of the third alternative embodiment, the drum, and the third attachment mechanism of the present invention taken along the line A-A of FIG. 27.
Figure 27:
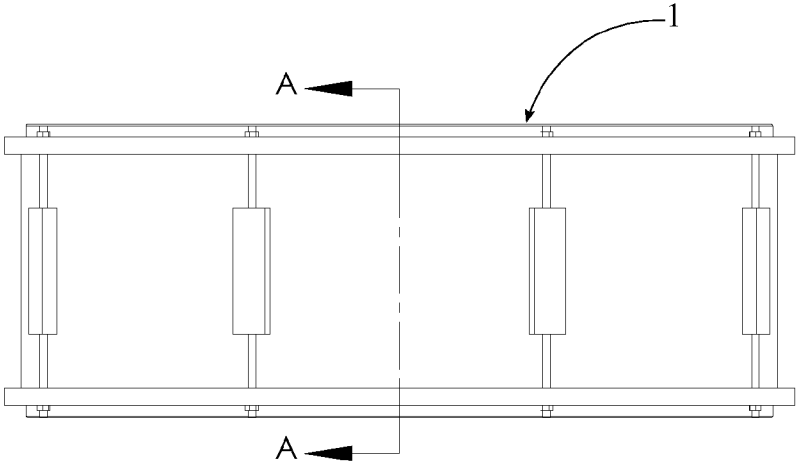
FIG. 27 is a front view of the third alternative embodiment, the drum, and the third attachment mechanism of the present invention, showing the plane upon which a cross sectional view is taken shown in FIG. 28.

In reference to FIG. 26, FIG. 27, and FIG. 28, the third alternative embodiment can be attached to drum 1 with a third attachment mechanism of the attachment mechanism 3. The third attachment mechanism comprises a bracket 31 and a sleeve 32, where the sleeve 32 is an adjustable sleeve 32, and the bracket 31 attaches with the sleeve 32 and the drum 1. More specifically, the bracket 31 is attached within the drum shell 13 by employing the existing bolts of the drum shell 13. If the drum shell 13 does not comprise existing bolts, the bracket 31 can be attached with a separate fastening device such as a male and female locking system, magnetic locking system, and snap locking system. Since the sleeve 32 is adjustable and attached with the bracket 31, the third alternative embodiment can attach within the sleeve 32 so that the third alternative embodiment can be positioned within the drum shell 13. When the third alternative embodiment is attached to the bracket 31, the sleeve 32 is positioned around the central portion 25, where the central portion 25 is perpendicularly positioned with the batter membrane 11 and the intake end portion 24 is adjacently positioned with the batter membrane 11. The bracket 31 may also have a plurality of gaps along the bracket 31 so that the sleeve 32 can be positioned in different placements along the bracket 31 for optimal performance of the third alternative embodiment. The plurality of gaps provides flexibility to the user so that the sleeve 32 can be easily secured along the bracket 31, as the sleeve 32 attaches to the bracket 31 through each of the plurality of gaps. Since the attachment mechanisms 3 of the first and second alternative embodiments are different from the third alternative embodiment, the first or second alternative embodiments can be used in conjunctions with the third alternative embodiment within the drum 1.

Although the invention has been explained in relation to its preferred embodiment, it is to be understood that many other possible modifications and variations can be made without departing from the spirit and scope of the invention as hereinafter claimed.

What is claimed is:

1. A system for removing overtone and resonance rings in an acoustic drum comprises:

a drum;

a tuning port;

an fastener mechanism;

the drum comprises a batter membrane, a resonant membrane, a drum shell, a first hoop, a second hoop, and a plurality of lugs;

the drum shell comprises a opening;

the tuning port comprises an outer surface, an inner surface, a plurality of dimples, an intake end portion, a central portion, an output end portion, and a plurality of locking protrusions;

the tuning port being attached to the drum by the fastener mechanism;

the fastener mechanism comprises at least one gasket and an attaching seal;

the at least one gasket being positioned around the output end portion;

the at least one gasket being positioned in between the flared end and the drum shell, wherein the cylindrical end is inserted into the opening;

the attaching seal being adjacently positioned with the opening within the drum shell; and the attaching seal being positioned around the plurality of locking protrusions, wherein the attaching seal secures the tuning port to the drum.

2. The system for removing overtone and resonance rings in an acoustic drum as claimed in claim 1 comprises:

The batter membrane being positioned across the drum shell;

the batter membrane being connected to the first hoop;

the resonant membrane being oppositely positioned from the batter membrane and positioned across the drum shell;

the resonant membrane being connected to the second hoop;

the plurality of lugs being connected on the drum shell;

the plurality of lugs comprises a plurality of tension rods;

the plurality of tension rods being connected to the plurality of lugs;

the first hoop being adjustably attached to the drum shell by the plurality of tension rods; and the second hoop being adjustably attached to the drum shell by the plurality of tension rods.

3. The system for removing overtone and resonance rings in an acoustic drum as claimed in claim 1 comprises:

the opening being traversed through the drum shell; and the opening being adjacently positioned with the batter membrane.

4. The system for removing overtone and resonance rings in an acoustic drum as claimed in claim 1 comprises:

the outer surface being oppositely positioned from the inner surface along the tuning port;

the plurality of dimples being positioned on the inner surface;

the central portion being linearly positioned in between the output end portion and the intake end portion;

the output end portion being a flared end;

the plurality of locking protrusions being positioned around the output end portion adjacent to the outer surface;

the central portion being a cylindrical body; and the intake end portion being a cylindrical end.

5. The system for removing overtone and resonance rings in an acoustic as claimed in claim 1 comprises:

The batter membrane being positioned across the drum shell;

the batter membrane being connected to the first hoop;

the resonant membrane being oppositely positioned from the batter membrane and positioned across the drum shell;

the resonant membrane being connected to the second hoop;

the plurality of lugs being connected on the drum shell;

the plurality of lugs comprises a plurality of tension rods;

the plurality of tension rods being connected to the plurality of lugs;

the first hoop being adjustably attached to the drum shell by the plurality of tension rods; and the second hoop being adjustably attached to the drum shell by the plurality of tension rods.

6. A system for removing overtone and resonance rings in an acoustic drum comprises:

a drum;

a tuning port;

an fastener mechanism;

the drum comprises a batter membrane, a resonant membrane, a drum shell, a first hoop, a second hoop, and a plurality of lugs;

the drum shell comprises a opening;

the tuning port comprises an outer surface, an inner surface, a plurality of dimples, an intake end portion, a central portion, an output end portion, and a plurality of locking protrusions;

the tuning port being attached to the drum by the fastener mechanism;

the fastener mechanism comprises at least one gasket and an attaching seal;

the at least one gasket being positioned around the output end portion;

the at least one gasket being positioned in between the flared end and the drum shell, wherein the output tube section is inserted into the opening;

the attaching seal being adjacently positioned with the opening within the drum shell;

the attaching seal being positioned around the plurality of locking protrusions, wherein the attaching seal secures the output end portion and the output tube section to the drum; and the intake tube section being removably attached to the output tube section within the drum shell.

7. The system for removing overtone and resonance rings in an acoustic drum as claimed in claim 6 comprises:

the opening being traversed through the drum shell; and the opening being adjacently positioned with the batter membrane.

8. The system for removing overtone and resonance rings in an acoustic drum as claimed in claim 6 comprises:

the outer surface being oppositely positioned from the inner surface along the tuning port;

the plurality of dimples being positioned on the inner surface;

the central portion being linearly positioned in between the output end portion and the intake end portion;

the output end portion being a flared end;

the plurality of locking protrusions being positioned around the output end portion adjacent to the outer surface;

the central portion being a cylindrical body;

the central portion comprises an intake tube section and an output tube section;

the intake tube section being adjacently positioned with the intake end portion;

the output tube section being adjacently positioned with the output end portion; and the intake end portion being a flared end.

9. A system for removing overtone and resonance rings in an acoustic drum comprises:

a drum;

a tuning port;

an fastener mechanism;

the drum comprises a batter membrane, a resonant membrane, a drum shell, a first hoop, a second hoop, and a plurality of lugs;

the tuning port comprises an outer surface, an inner surface, a plurality of dimples, an intake end portion, a central portion, and an output end portion;

the tuning port being attached to the drum by the fastener mechanism;

the fastener mechanism comprises a bracket and a sleeve;

the bracket being attached with the sleeve and the drum shell;

the sleeve being attached around the central portion;

the bracket and the sleeve being positioned within the drum shell;

the central portion being perpendicularly positioned with the batter membrane; and the intake portion being adjacently positioned with the batter membrane.

10. The system for removing overtone and resonance rings in an acoustic drum as claimed in claim 9 comprises:

The batter membrane being positioned across the drum shell;

the batter membrane being connected to the first hoop;

the resonant membrane being oppositely positioned from the batter membrane and positioned across the drum shell;

the resonant membrane being connected to the second hoop;

the plurality of lugs being connected on the drum shell;

the plurality of lugs comprises a plurality of tension rods;

the plurality of tension rods being connected to the plurality of lugs;

the first hoop being adjustably attached to the drum shell by the plurality of tension rods; and the second hoop being adjustably attached to the drum shell by the plurality of tension rods.

11. The system for removing overtone and resonance rings in an acoustic drum as claimed in claim 9 comprises:

the outer surface being oppositely positioned from the inner surface along the tuning port;

the plurality of dimples being positioned on the inner surface;

the central portion being linearly positioned in between the output end portion and the intake end portion;

the output end portion being a flared end;

the central portion being a cylindrical body; and the intake end portion being a flared end.

12. A system for removing overtone and resonance rings in an acoustic drum comprises:

a drum;

a tuning port;

an fastener mechanism;

the drum comprises a batter membrane, a resonant membrane, a drum shell, a first hoop, a second hoop, and a plurality of lugs;

the drum shell comprises a opening;

the tuning port comprises an outer surface, an inner surface, a plurality of dimples, an intake end portion, a central portion, an output end portion, and a plurality of locking protrusions;

the tuning port being attached to the drum by the fastener mechanism;

the fastener mechanism comprises an external plate, an internal plate, and a plurality of fasteners;

the external plate being adjacently positioned around the output end portion;

the external plate being positioned in between the flared end and the drum shell, wherein the cylindrical end is inserted into the opening;

the internal plate being adjacently positioned with the opening within the drum shell; and the plurality of fasteners being traversed through the external plate, drum shell, and the internal plate, wherein the plurality of fastener secures the tuning port to the drum.

13. The system for removing overtone and resonance rings in an acoustic drum as claimed in claim 12 comprises:

The batter membrane being positioned across the drum shell;

the batter membrane being connected to the first hoop;

the resonant membrane being oppositely positioned from the batter membrane and positioned across the drum shell;

the resonant membrane being connected to the second hoop;

the plurality of lugs being connected on the drum shell;

the plurality of lugs comprises a plurality of tension rods;

the plurality of tension rods being connected to the plurality of lugs;

the first hoop being adjustably attached to the drum shell by the plurality of tension rods; and the second hoop being adjustably attached to the drum shell by the plurality of tension rods.

14. The system for removing overtone and resonance rings in an acoustic drum as claimed in claim 12 comprises:

the opening being traversed through the drum shell; and the opening being adjacently positioned with the batter membrane.

15. The system for removing overtone and resonance rings in an acoustic drum as claimed in claim 12 comprises:

the outer surface being oppositely positioned from the inner surface along the tuning port;

the plurality of dimples being positioned on the inner surface;

the central portion being linearly positioned in between the output end portion and the intake end portion;

the output end portion being a flared end;

the plurality of locking protrusions being positioned around the output end portion adjacent to the outer surface;

the central portion being a cylindrical body; and the intake end portion being a cylindrical end.

16. A system for removing overtone and resonance rings in an acoustic drum comprises:

a drum;

a tuning port;

an fastener mechanism;

the drum comprises a batter membrane, a resonant membrane, a drum shell, a first hoop, a second hoop, and a plurality of lugs;

the drum shell comprises a opening;

the tuning port comprises an outer surface, an inner surface, a plurality of dimples, an intake end portion, a central portion, an output end portion, and a plurality of locking protrusions;

the tuning port being attached to the drum by the fastener mechanism;

the fastener mechanism comprises an external plate, an internal plate, and a plurality of fasteners;

the external plate being adjacently positioned around the output end portion;

the external plate being positioned in between the flared end and the drum shell, wherein the output tube section is inserted into the opening;

the internal plate being adjacently positioned with the opening within the drum shell;

the plurality of fasteners being traversed through the external plate, drum shell, and the internal plate, wherein the plurality of fastener secures the output end portion and the output tube section to the drum; and the intake tube section being removably attached to the output tube section within the drum shell.

17. The system for removing overtone and resonance rings in an acoustic as claimed in claim 16 comprises:

The batter membrane being positioned across the drum shell;

the batter membrane being connected to the first hoop;

the resonant membrane being oppositely positioned from the batter membrane and positioned across the drum shell;

the resonant membrane being connected to the second hoop;

the plurality of lugs being connected on the drum shell;

the plurality of lugs comprises a plurality of tension rods;

the plurality of tension rods being connected to the plurality of lugs;

the first hoop being adjustably attached to the drum shell by the plurality of tension rods; and the second hoop being adjustably attached to the drum shell by the plurality of tension rods.

18. The system for removing overtone and resonance rings in an acoustic drum as claimed in claim 16 comprises:

the opening being traversed through the drum shell; and the opening being adjacently positioned with the batter membrane.

19. The system for removing overtone and resonance rings in an acoustic drum as claimed in claim 16 comprises:

the outer surface being oppositely positioned from the inner surface along the tuning port;

the plurality of dimples being positioned on the inner surface;

the central portion being linearly positioned in between the output end portion and the intake end portion;

the output end portion being a flared end;

the plurality of locking protrusions being positioned around the output end portion adjacent to the outer surface;

the central portion being a cylindrical body;

the central portion comprises an intake tube section and an output tube section;

the intake tube section being adjacently positioned with the intake end portion;

the output tube section being adjacently positioned with the output end portion; and the intake end portion being a flared end.

* * * * *